US006140897A

United States Patent [19]

Mueller et al.

[11] Patent Number: 6,140,897

[45] Date of Patent: Oct. 31, 2000

[54] CIRCUIT BREAKER WITH EXTERNALLY LOCKABLE SECONDARY COVER LATCH

[75] Inventors: Robert W. Mueller, Aliquippa; David B. Miller, West Lawn, both of Pa.; David M. Werling, Greenwood, S.C.

[73] Assignee: Eaton Corporation, Cleveland, Ohio

[21] Appl. No.: 09/377,013

[22] Filed: Aug. 18, 1999

[51] Int. Cl.[7] ..... H01H 9/00

[52] U.S. Cl. ..... 335/172; 335/202; 200/43.5

[58] Field of Search ..... 335/167–176, 335/6, 132, 23, 25, 35, 37, 42, 45, 202; 200/43.01–43.21, 293–303; 218/154, 155

[56] References Cited

U.S. PATENT DOCUMENTS

| | | | |
|---|---|---|---|
| 5,113,043 | 5/1992 | Morris | 200/43.01 |
| 5,463,196 | 10/1995 | Darimont | 200/43.16 |
| 5,485,134 | 1/1996 | Seymour et al. | 335/132 |
| 5,896,225 | 11/1999 | Castonguay et al. | 200/308 |
| 5,910,760 | 6/1999 | Malingowski | 335/167 |
| 5,936,535 | 8/1999 | Rosen et al. | 340/638 |

*Primary Examiner*—Lincoln Donovan
*Assistant Examiner*—Tuyen T. Nguyen
*Attorney, Agent, or Firm*—Martin J. Moran

[57] ABSTRACT

This concerns a molded case circuit breaker having separable main contacts and an operating mechanism structured to cause the separable main contacts to open and close. A trip unit is provided to actuate the operating mechanism in desirable circumstances. The circuit breaker housing has an auxiliary device compartment therein into which may be inserted a key lock arrangement. The trip unit has a plunger member which protrudes into the auxiliary device compartment and which, when actuated, causes the trip unit to actuate the operating mechanism to open the main contacts. When the key lock is actuated, a slideable member interacts with the plunger member in the trip unit and maintains the trip unit in a configuration that prevents the main contacts from engaging. Thus, as long as the lock member is maintained in the locked state, the circuit breaker may not be reset.

8 Claims, 26 Drawing Sheets

CIRCUIT BREAKER WITH EXTERNALLY LOCKABLE SECONDARY COVER LATCH

CROSS REFERENCE TO RELATED APPLICATIONS

The subject matter of this invention is related to concurrently filed, co-pending applications: U.S. patent application Ser. No. 09/377,001 filed Aug. 18, 1999, entitled "Circuit Breaker With Easily Installed Removable Trip Unit"; U.S. patent application Ser. No. 09/376,897, filed Aug. 18, 1999, entitled "Circuit Breaker With Lockable Trip Unit Adjustment Cover"; U.S. patent application Ser. No. 09/376,920, filed Aug. 18, 1999, entitled "Circuit Breaker With Combined Slot Motor, Reverse Loop And Terminal Strap"; U.S. patent application Ser. No. 09/376,248, filed Aug. 18, 1999, entitled "Circuit Breaker With Combination Push-To-Trip And Secondary Cover Latch"; U.S. patent application Ser. No. 09/376,265, filed Aug. 18, 1999, entitled "Multi-Pole Circuit Breaker With Multiple Trip Bars"; U.S. patent application Ser. No 09/376,816, filed Aug. 18, 1999, entitled "Circuit Breaker With Trip Unit Mounted Tripping Plunger And Latch Therefore", U.S. patent application Ser. No. 09/377,018, filed Aug. 18, 1999, entitled "Circuit Breaker With Non-Symmetrical Terminal Collar"; U.S. patent application Ser. No. 09/376,815, filed Aug. 18, 1999, entitled "Circuit Breaker With Side Wall Opening For A Separate Auxiliary Device Actuation Lever"; and U.S. patent application Ser. No. 09/376,254, filed Aug. 18, 1999, entitled "Circuit Breaker With Dial Indicator For Magnetic Trip Level Adjustment".

BACKGROUND OF THE INVENTION

1. Field of the Invention

The subject matter of this invention is related generally to molded case circuit breakers and more specifically to locks and latches for secondary covers.

2. Description of the Prior Art

Molded case circuit breakers are well known in the art as exemplified by U.S. Pat. No. 5,910,760 issued Jun. 8, 1999 to Malingowski et al., entitled "Circuit Breaker with Double Rate Spring" and assigned to the assignee of the present application. The foregoing is incorporated herein by reference.

Molded case circuit breakers include a set of separable main contacts, one of which is usually fixed and one of which is movable for automatically opening upon the occurrence of an overload or short circuit electrical current in the network which the circuit breaker is provide to protect. The separable main contacts are opened as a result of the functioning of a latched operating mechanism, which is interconnectable by way of an operating handle to a region outside of the circuit breaker. The operating handle may be used to trip the circuit breaker manually or to reset and close the circuit breaker contacts once they have been opened automatically. The reset action is required because circuit breakers must be mechanically charged to be in a state to reopen immediately upon closure in the event that the fault which cause the tripping in the first place has not disappeared. The reset action charges the circuit breaker for that purpose. Molded case circuit breakers have trip units, which are often removably insertable in the circuit breaker case. The trip unit in addition has at least two calibratable functions, one of which is generally identified as thermal tripping and the other of which is generally identified as magnetic tripping. The trip unit includes a rotatable trip bar, which when rotated will actuate a latchable tripping operation within the operating mechanism to automatically open the circuit breaker contacts. The rotatable trip bar is usually actuated in one of two ways. The first way is in response to what is called a magnetic tripping of the circuit breaker. This occurs when the amount of current flowing through the separable main contacts of the circuit breaker is so high as to represent a potential catastrophic failure and which therefore requires exceedingly quick opening action of the circuit breaker. In such a case a electron magnetic core, which produces magnetic flux in proportion to the amount of electrical current flowing through the separable main contacts attracts a movable armature, the movement of which eventually causes the trip bar to move to thus cause the tripping action. The second tripping occurrence is in response to a relatively low amount of overload current, which eventually will cause overheating of the electrical wires in the circuit to be protected, but which does not necessitate the instantaneous action a short circuit requires and thus does not require the magnetic action spoken of previously. In this case a bi-metal element is heated by a heater element which conducts the electrical current flowing through the separable main contacts. As the bi-metal element flexes or moves it impinges upon the tripping bar causing it to flex and move correspondingly, until eventually a point is reached in which the tripping bar causes the circuit breaker to unlatch and trip automatically. Both the magnetic trip mechanism and the thermal trip mechanism usually require initial calibration.

In one half of an AC cycle, the electrical current flows through the circuit interrupter from the load by way of a terminal collar to the load terminal of the circuit breaker and from there into the trip unit where it flows through the previously mentioned heater which in turn is serially connected to the electron magnetic member of the magnetic trip device. From there it is interconnected by way of a flexible cable to one end of a moveable contact arm and from there to the main contact on the moveable contact arm. When the contact arm is closed, it is closed upon a fixed contact which is supported usually on u-shaped conductor, which in turn is interconnected with a line terminal and there to the line terminal collar and finally to the electrical line. In addition the circuit breaker usually has an arc chute for assisting in diminishing the electrical arc drawn between the separating contacts during the opening operation for extinguishing of the arc. The circuit breaker also has a slot motor arrangement, which is utilized to interact magnetically with the electrical current flowing in the opening contact arm to accelerate the opening of the contact arm magnetically. The operating mechanism usually consists of a series of levers and linkages, which are interconnected with the separable main moveable contact arm, the handle mechanism, and by way of a latch arrangement with the aforementioned trip bar. Description and operation of all of the above may be found in the previous mentioned, incorporated by reference '760 patent.

As was mentioned each circuit breaker usually contains a trip unit which is a separate unit was is integrated into the circuit breaker case during the construction process and which carries the responsibility of initialing the tripping of a circuit breaker either due to a magnetic level overload or a thermal level overload. An example of such a trip unit may be found in the aforementioned U.S. Pat. No. 5,901,760. Utilization of a trip unit of this kind usually requires mounting of the trip unit from the front of faceplate side thereof and that requires that the area above the mounting screws for the circuit breaker be left open to allow access for a driver which often results into wasted space of as much as ⅜". It would be advantageous if a trip unit could be found in which this wasted space is no longer required and which could be placed into the circuit breaker very late in the manufacturing process, even after the main circuit breaker frame had been completed.

SUMMARY OF THE INVENTION

In accordance with the invention there is provided a circuit interrupter having a housing with an auxiliary device compartment therein. There is an operating mechanism disposed within the housing. Separable contacts are disposed within the housing in cooperation with the operating mechanism for being opened by the operating mechanism. A triggerable tripping member is disposed in the housing for cooperating with the operating mechanism for actuating the operating mechanism for opening the separable contacts. A triggering device is disposed in the housing and accessible from the auxiliary device compartment for triggering the triggerable tripping member for actuating the operating mechanism for opening the separable contact. A locking device is disposed in the auxiliary device compartment in the housing for, when actuated, interacting with the triggering device for triggering the triggerable tripping member for actuating the operating mechanism for opening the separable contacts.

BRIEF DESCRIPTION OF THE DRAWINGS

In accordance with the invention, reference may be had to the preferred embodiment thereof, shown in the accompanying drawings in which.

DESCRIPTION OF THE PREFERRED EMBODIMENT

Figure 1:
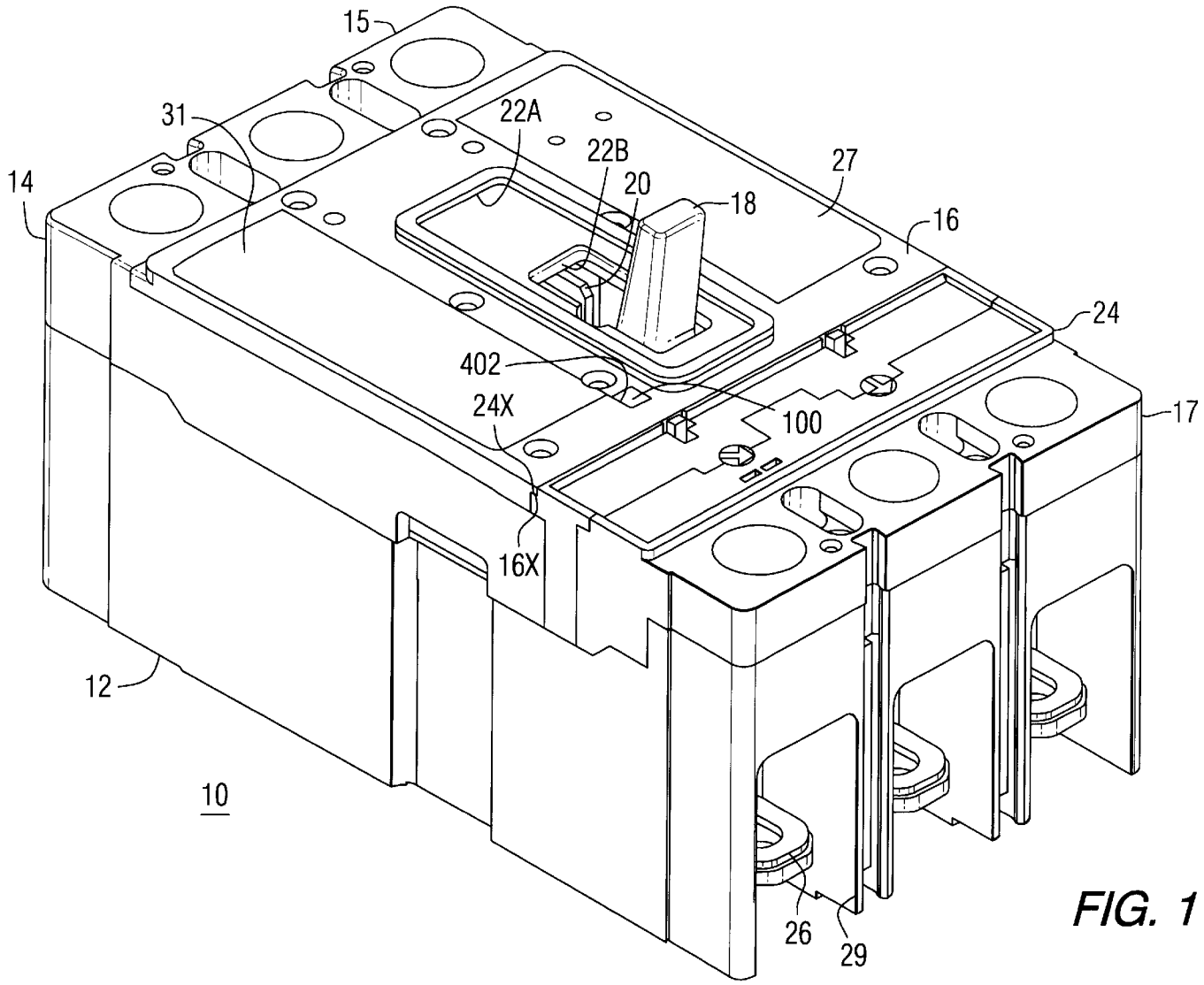
FIG. 1 is an orthogonal view of a three-phase molded case circuit breaker employing embodiments of the present invention.

Referring now to the drawings and FIGS. 1 through 5 in particular, there is shown a molded case circuit breaker or interrupter 10 having a main base 12 and primary cover 14. Attached to the primary cover 14 is a secondary cover 16. A handle 18 extends through a secondary escutcheon 22A in the secondary cover 16 and aligned primary escutcheon 22B in the primary cover 14. An operating mechanism 20 is interconnected with the handle 18 for opening and closing separable main contacts in a manner which will be described hereinafter. This circuit breaker has a line end 15 and load end 17. The circuit breaker or interrupter includes a removable trip unit 24. Removable trip unit 24 has an underlapping lip 24X, the purpose of which will be described hereinafter. There are also depicted a load terminal 26, a right side accessory region or pocket 27 and a left side accessory pocket or region 31.

Figure 2:
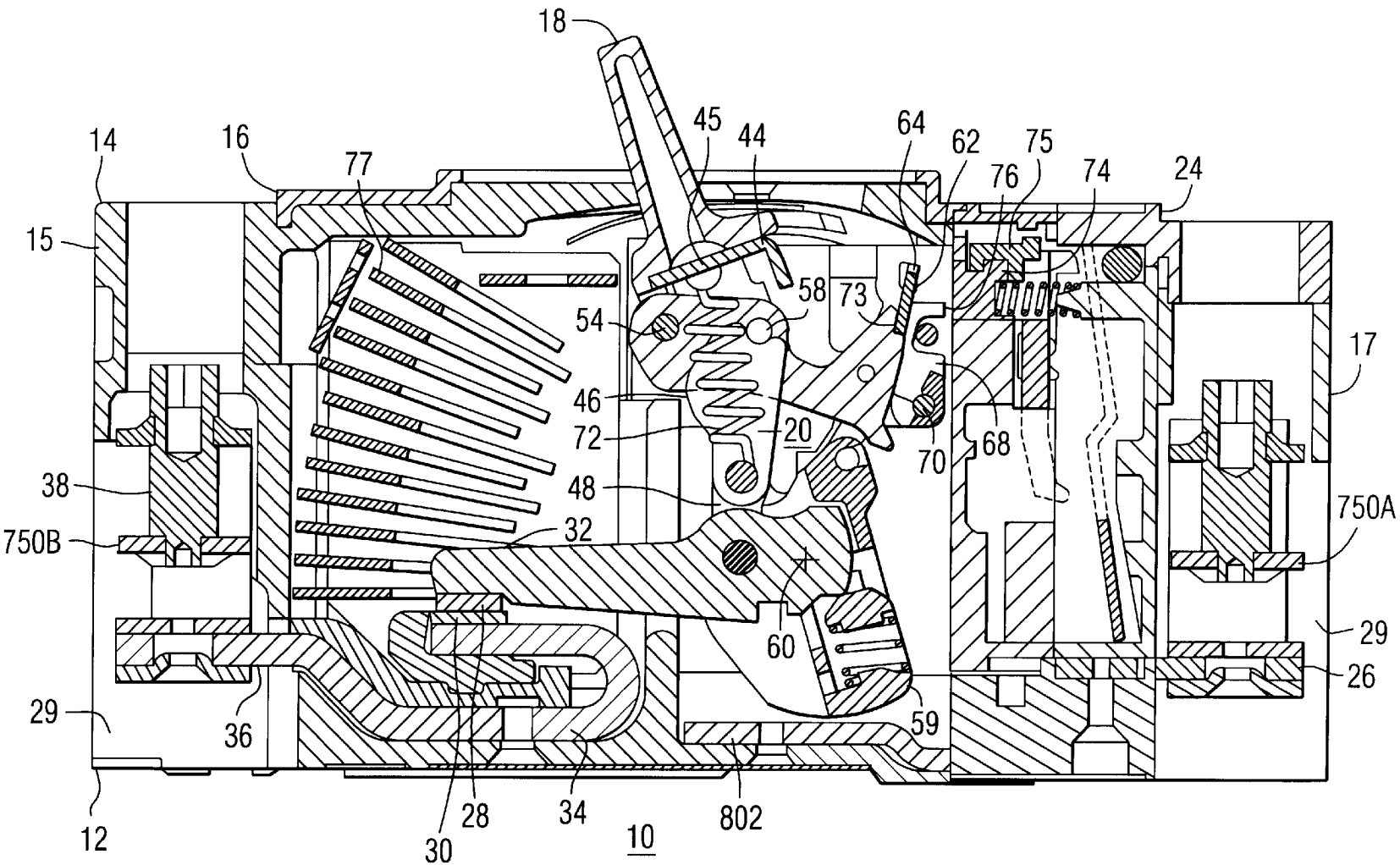
FIG. 2 is a cut away side elevation section of the circuit breaker of FIG. 1, depicting the circuit interrupter in the closed state.
Figure 3:
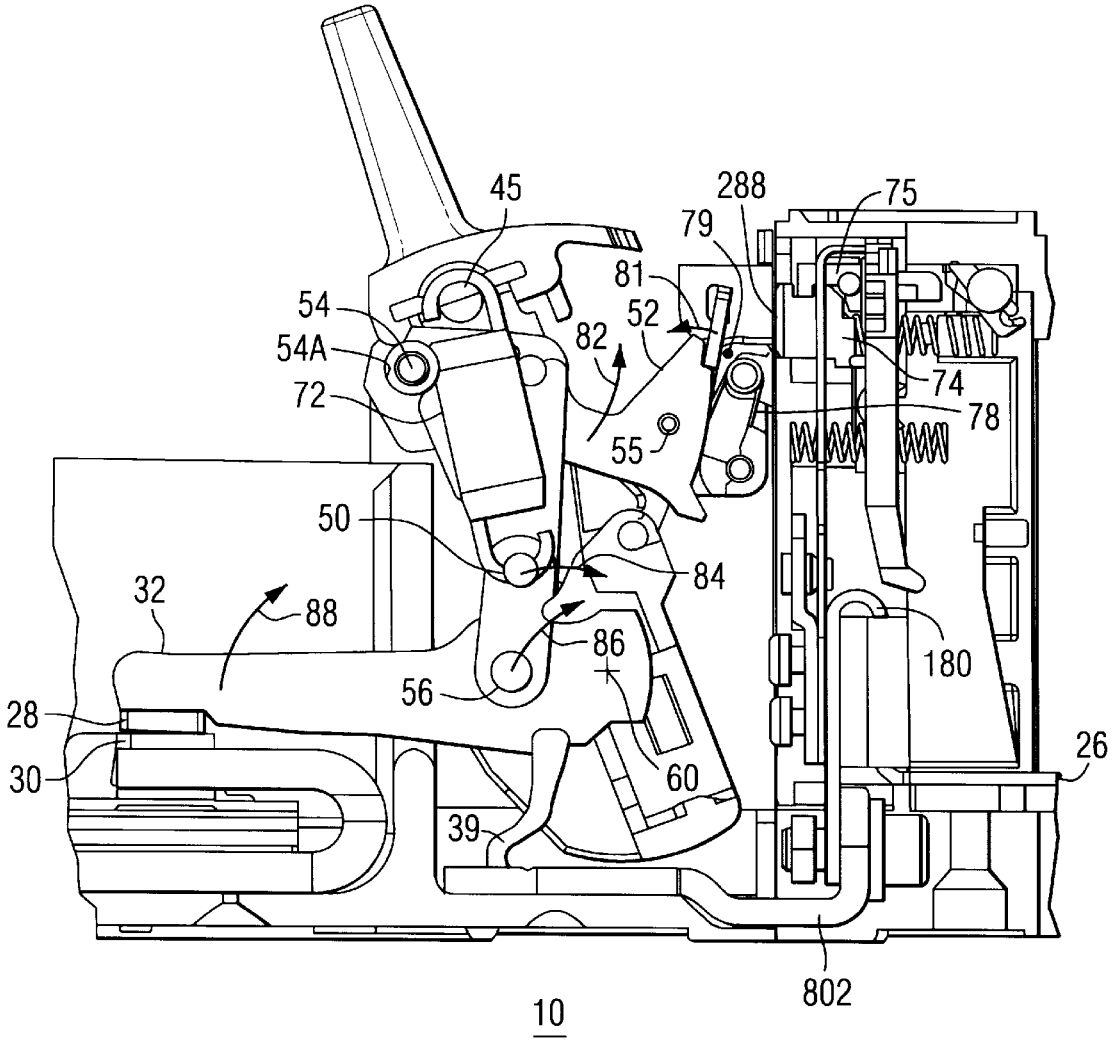
FIG. 3 is a side elevation view similar to that shown in FIG. 2, concentrating on the circuit breaker operating mechanism and trip unit.
Figure 4:
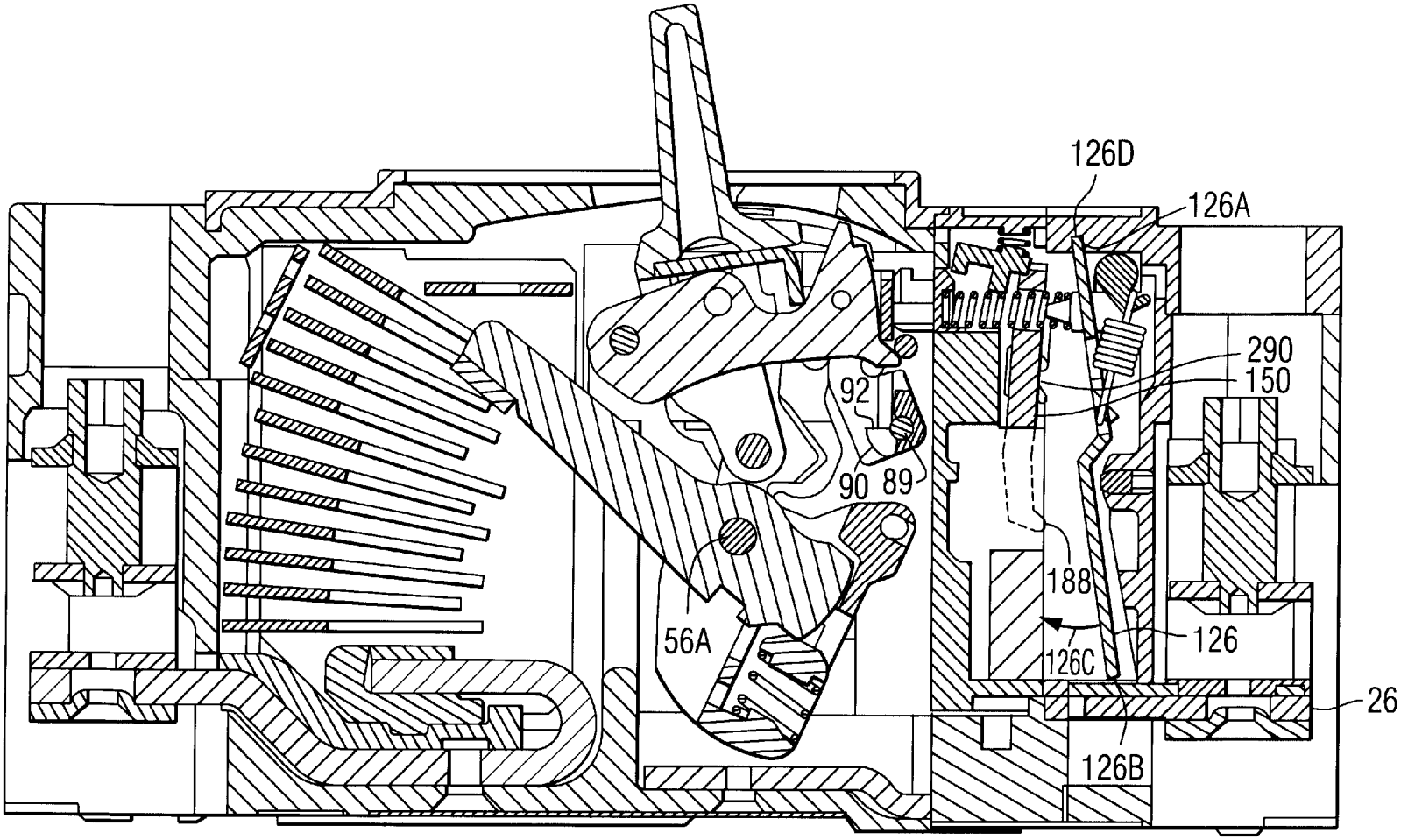
FIG. 4 is similar to FIG. 2, but depicts the circuit interrupter in the tripped state.
Figure 5:
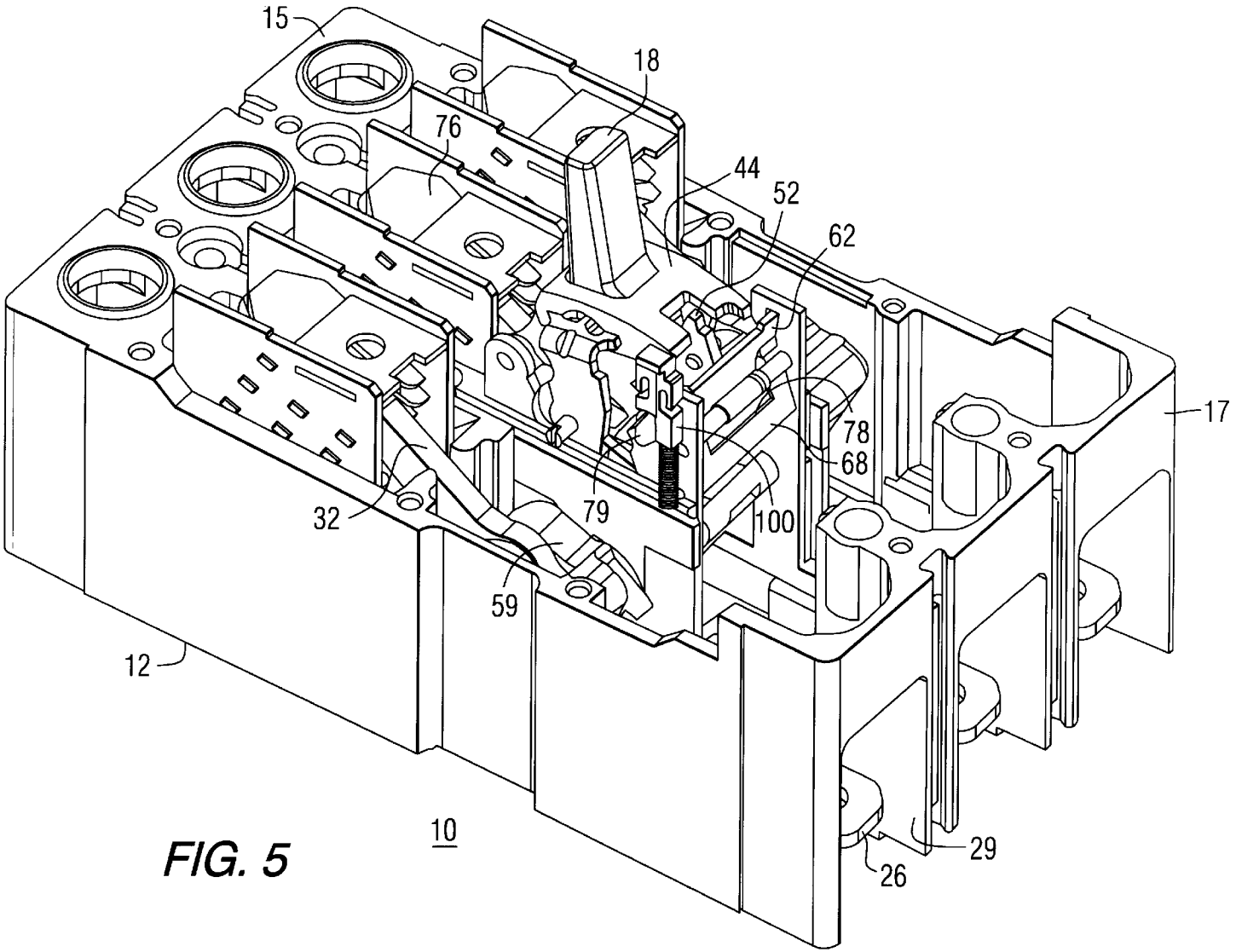
FIG. 5 shows an orthogonal view similar to that shown in FIG. 1, but with both the primary and secondary covers removed.
Figure 6:
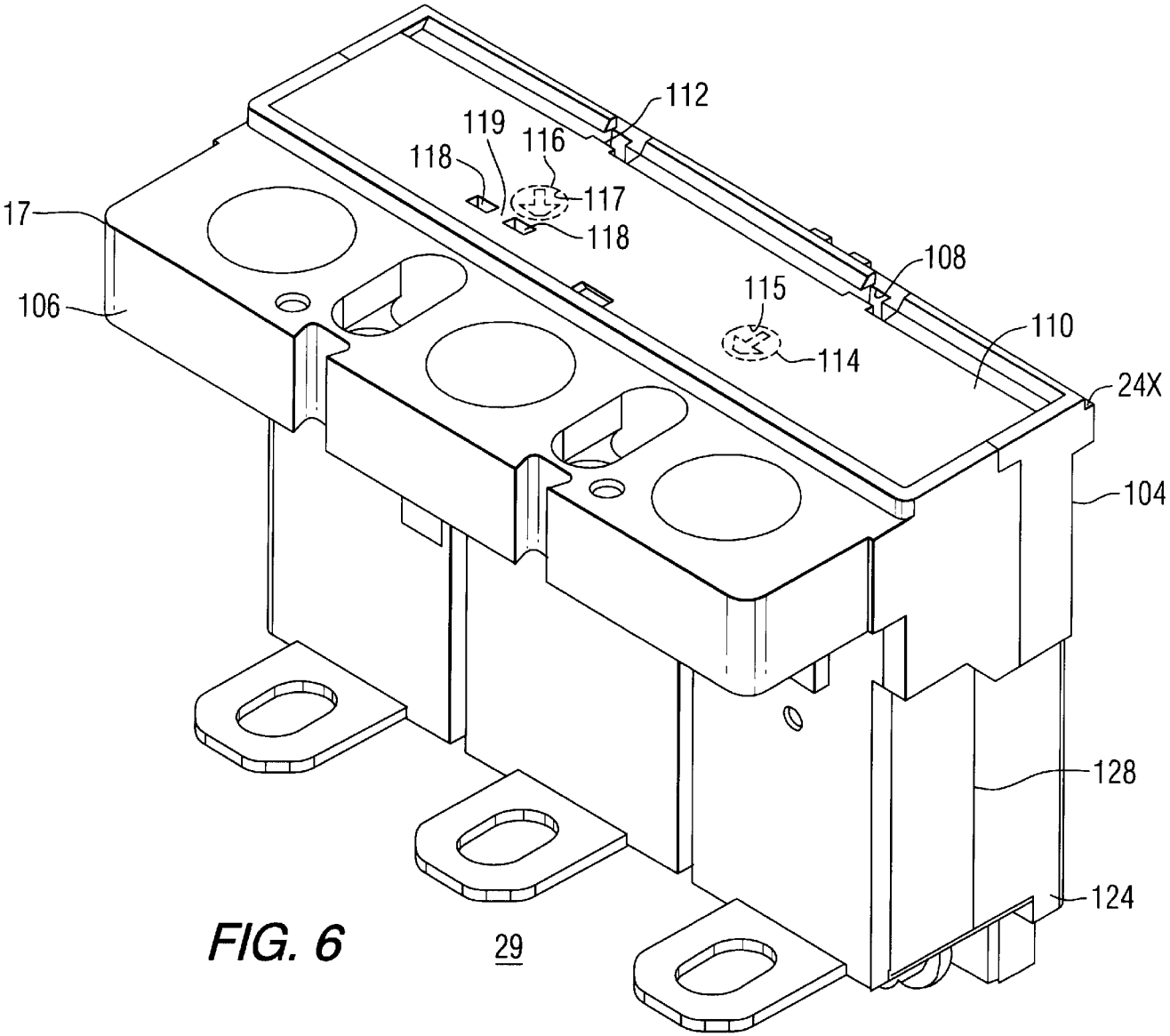
FIG. 6 shows an orthogonal view of the removable trip unit of the circuit breaker of FIG. 1.

Referring now more specifically to FIGS. 2, 3 and 4, there are depicted a separable movable contact 28 disposed upon a moveable contact arm 32 and a fixed contact 30 disposed upon a fixed contact support or u-shaped member 34. Line terminal 36 is disposed to the left in FIG. 2, for example, at the line end 15 of the circuit interrupter in a terminal cave or pocket 29. A load terminal 26 is disposed to the right in FIG. 2, for example, in a load terminal cave or pocket 29. To the left on the line terminal 36 is disposed a line terminal collar 38 which will be described in more detail hereinafter, and to the right is provided a load terminal jumper-to-movable contact arm conductor 802. Connected to conductor 802 is a flexible conductor 39, which is interconnected with movable contact arm 32 as shown schematically. The load terminal jumper or frame conductor 802 is interconnected at its other end with a bi-metal heater 180, which in turn is interconnected at its other end with the terminal 26. Consequently, when the circuit interrupter separable main contacts 28 and 30 are closed upon each other, there is a complete circuit through the circuit interrupter from right to left starting with line conductor 26 through bi-metal heater 180, through load terminal jumper or frame conductor 802, through flexible conductor 39, through the movable contact arm 32, through contact 28 to contact 30 and from there through the fixed contact support or u-shaped member 34 to line terminal 36.

There is provided a operating mechanism 20 for assisting in opening and closing the separable main contacts 28 and 30. In particular, the operating mechanism includes a cradle 52, which is pivoted on one end at a cradle fixed pivoted pin 54 by way of an opening 54A in the cradle for placement of the cradle fixed pivoted pin therein. The cradle includes a cradle-to-side accessory region side protrusion 55. There is provided an upper toggle link 46 and a lower toggle link 48. They are joined pivotally by an upper and lower toggle link pin 50. There is provided a lower toggle link to movable contact arm main pivot assemble attachment pin 56, which is affixed to the movable contact arm 32 at an opening 56A. There is also a cradle to upper toggle link pivot pin 58, by which the upper toggle link 46 is placed in physical contact with the cradle 52. There is also provided a movable contact arm main pivot assembly 59, which movably, rotatably pivots on a pivot 60. There is also provided a primary frame latch 62 which operates or rotates on a primary frame latch pivot 64. The primary frame latch 62 cooperates with a secondary frame latch 68, which rotates on a secondary frame latch pivot 70. The operating power for the tripping operating of the circuit breaker is provided by a charged main toggle coil spring 72. The main toggle coil spring is interconnected with a handle yoke 44 by way of a handle yoke attachment post 45. The other end of the spring 72 is attached to the toggle link pin 50. Cradle 52 has a cradle lip 73, which is captured or held in place by the primary latch 62 when the separable main contacts 28 and 30 are closed. No tripping of the circuit breaker can take place by way of the operating mechanism until the aforementioned primary frame latch 62 has been actuated away from the cradle lip 73 in a manner which will be described hereinafter. There is provided a combination secondary-frame-latch-primary-frame-latch torsion spring 78, which exerts force against both latches sufficient to cause appropriate movement thereof at the appropriate time. The secondary frame latch has a laterally extending trip protrusion 79, the purpose of which will be described later hereinafter. Actuation of the primary and secondary frame latches occurs exclusively by way of the utilization of a resetable trip unit trip plunger 74, which is contained entirely within the removable trip unit 24. The trip unit trip plunger 74 is controlled or latched by way of a plunger latch or interference latch 75. The secondary frame latch 68 is in disposition to be struck by the moving trip unit plunger abutment surface 288. Upon opening of the separable main contacts 30 and 28, an electric arc is drawn therebetween which is exposed to an arc chute 77. The secondary frame latch 68 has a bottom portion 89, upon which is disposed an arcuate stop surface 90 for the primary frame latch 62. There is also provided above that arcuate stop surface and as part of the acruate stop member a latch surface 92.

The operating mechanism described herein may be the same as found in U.S. Pat. No. 5,910,760 issued Jun. 8, 1999 to Malingowski et al., entitled "Circuit Breaker with Double Rate Spring". Thought the primary and secondary frame latches are disposed within the case 12, the trip unit plunger 75 is responsible for initiating all tripping action from the trip unit 24 into the region of the secondary latch 68. Alternatively, the secondary latch 68 may be actuated by a push-to-trip button in a manner, which will be described hereinafter. The secondary latch 68 is actuated to rotate to the left as shown in FIGS. 2, 3 and 4, for example, in direction 81 about its pivot 70. As this occurs the acruate stop surface 90 for the secondary frame latch 68 rotates away from the bottom of the primary frame latch 62 until the lateral latch surface 92 rotates into a disposition to allow the bottom of the primary frame latch 62 to rotate to the right under the force of the cradle 72. This causes the primary frame latch 62 to clear the lip 73 of the cradle 52 to allow the cradle 52 to rotate upwardly about its pivot 54 in a direction 82 under the power of the now collapsing coil spring 72 by way of the force exerted thereupon by the upper toggle link 46 acting against the cradle-to-upper-toggle link connecting pin 58. As the toggle spring 72 relaxes, the upper and lower toggle links collapse, which in turn causes the lower toggle link to movable contact arm pivot assembly 56 to rotate upwardly in the direction 86 about its pivot 60. This, of course, causes the contact arm 32 to rotate similarly in the direction 88, thus opening the separable main contacts 28 and 30 and in most cases establishing an electrical arc of conducting electrical current there across. The action of the secondary frame latch 68 can be duplicated by causing secondary latch push-to-trip member side laterally extending trip protrusion 79 to rotate in the direction 81 by operation of a push-to-trip member which will be described later hereinafter. Resetting of the circuit breaker is accomplished in a matter well known in the prior art and described and shown with respect to the aforementioned U.S. Pat. No. 5,910,760. The important part of the operation with respect to this feature is the movement of the secondary frame latch point 76 in the direction opposite to direction 82, against the plunger face 288 in a manner, which will be described later hereinafter. However, if movement of the plunger face 288 in the rightward direction against its plunger spring, as will be described hereinafter, is prevented because of the latching of the plunger member 74, in a manner which will be described hereinafter, then the circuit breaker can not be reset. An important feature of the invention lies in the fact that the ultimate control of the resetting of the circuit breaker and tripping of the circuit breaker can be accomplished only from the removable trip unit 24, rather than from the operating mechanism 20.

Continuing to refer to FIGS. 1 through 5 and 6. Further detail concerning the removable trip unit 24 is set forth. In particular, removable trip unit 24 includes a back or rear portion 104 and front portion 106, which are snuggly interjoined to form the complete trip unit main body or case 124. The load end of the circuit breaker 17 is depicted at the front portion 106 of the trip unit 24. There is provided on the top of the trip unit 104 at the most rear portion thereof, a rear under lapping lip 24X, the purpose of which will be described hereinafter. There is also provided two hinge regions 108, these hinge regions or receptacles 108 are utilized to receive the L-shaped cover hinges 112, as will be described hereinafter. The L-shaped cover hinges 112 are at the rear of a trip unit cover 110, which in this embodiment of the invention may be transparent. There is provided in the top of the case 124, two openings 115 and 117, for a thermal adjustment dial 114 and a magnetic adjustment dial 116, respectively. In opening 115 is disposed the thermal adjustment dial 114, which is utilized to adjust or calibrate the circuit breaker for tripping on lower levels of overload current, which may be flowing through load terminal 26, for example. There may be disposed in opening 117 the magnetic adjustment dial 116 which may be utilized to adjust or calibrate the circuit breaker trip unit for higher levels of overload current flowing through the load terminals 26. There are also provided in the cover 110 a pair of bridged through holes or openings 118 surrounding or disposed around a bridge 119 on the trip unit cover 110.

Figure 7:
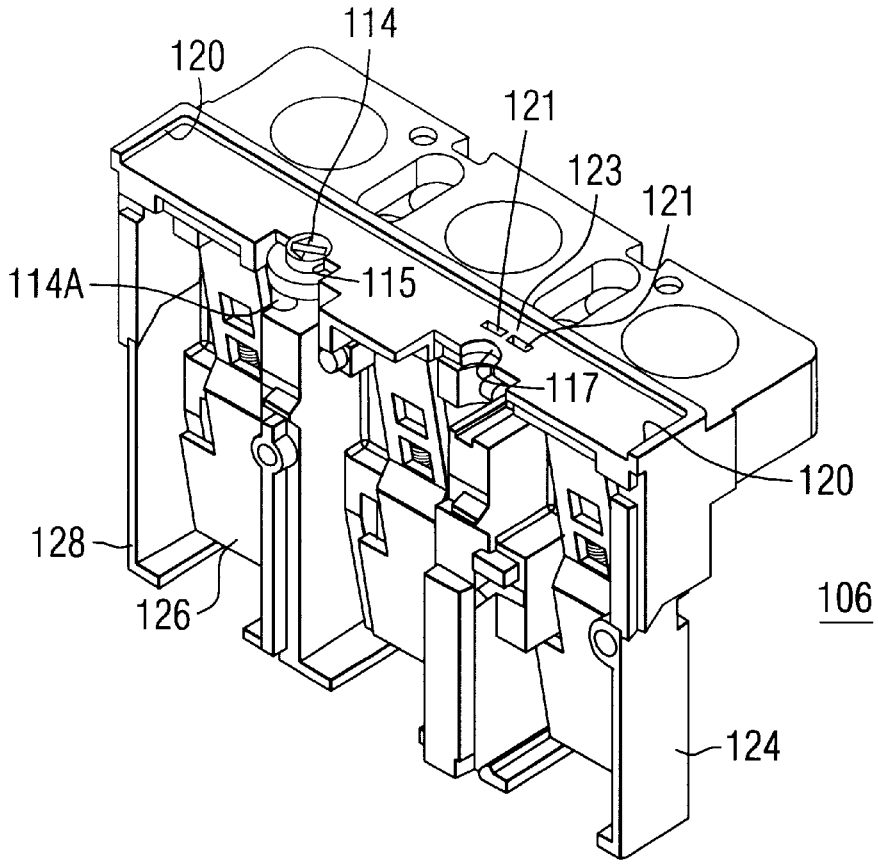
FIG. 7 shows an orthogonal view, partially broken away, of the front portion of the trip unit of FIG. 6, as viewed from the back.
Figure 8:
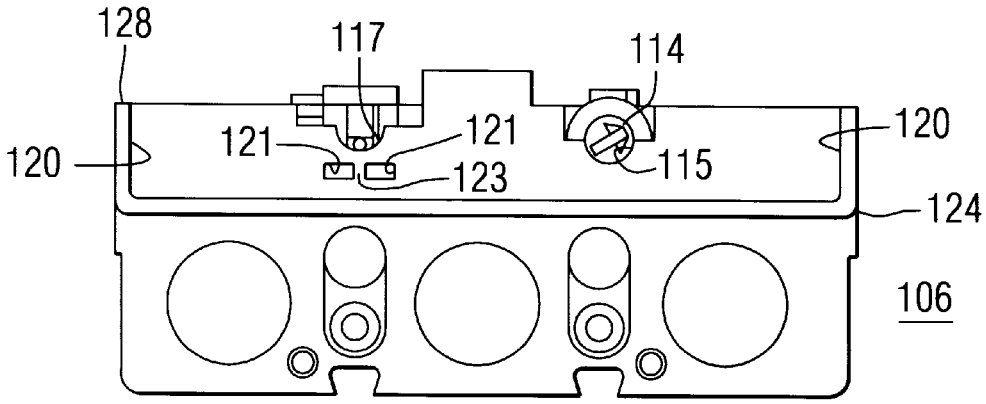
FIG. 8 shows a top view of the portion shown in FIG. 7.

Referring now to FIGS. 7 and 8, there is shown the front portion 106 of the case 124 in greater detail. In particular, the previously described openings 115 and 117 are shown. The thermal adjustment dial 114 is shown disposed in its opening 115. There is shown disposed at the bottom of the dial 114, a thermal adjustment dial lower protrusion 114A the purpose of which will be described hereinafter. There are shown in the top of the trip unit, bridged interconnecting holes 121 as bridged by a cover portion 123. These align with the previously mentioned holes 118 and bridge 119 in the cover 110, when the cover 110 is in a disposition for locking which will be described hereinafter. There is also shown a raised ridge 120, the raised ridge 120 interacts with the cover 110 in a manner which will be described hereinafter, for completing the locking arrangement between the cover 110 and the case 124. Also shown is a magnetic armature 126, the purpose of which will be described hereinafter.

Continuing to refer to FIGS. 7 and 8 and also to FIG. 6 again, the trip unit interface surface 128 is depicted and shown in both the disassembled and assembled state.

Figure 9:
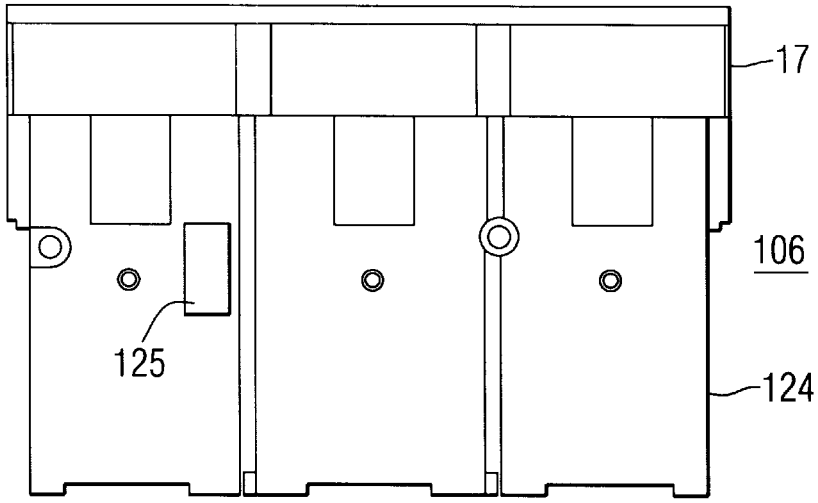
FIG. 9 shows a front view of the portion shown in FIG. 7.
Figure 10:
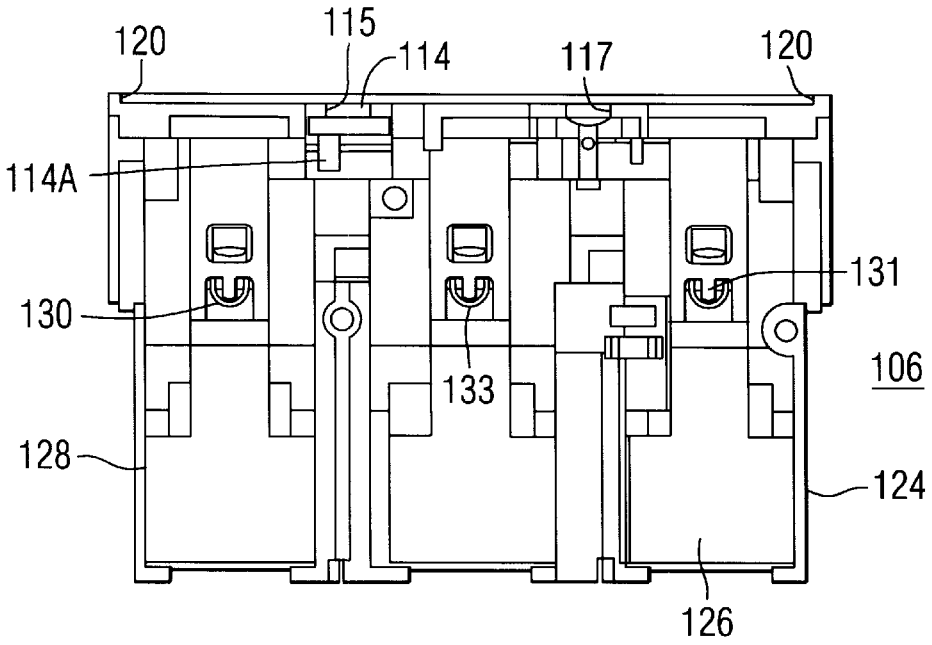
FIG. 10 shows a rear view of the portion shown in FIG. 7.

Referring now to FIGS. 9 and 10, other views of the front portion 106 are depicted. FIG. 9 shows a front view of the front region 106 as is clearly demonstrated by the presence of the load end 17 of the circuit breaker. An earth leakage actuation button 125, which forms no part of the present invention is shown for purposes of clarity. Also, referring to FIG. 10, the obverse side of the view of FIG. 9 is depicted. This is the back portion of the trip unit front portion 106. Side views of the cut outs 115 and 117 are clearly depicted, as well as the presence of the thermal adjustment dial 114 with downwardly protruding lower protrusion 114A. Once again, the raised ridge 120 is clearly depicted. There is provided a magnetic armature spring 130 which is utilized to provide resistive force against the movement of the armature 126. The armature spring 130 has a lower or anchor end 133, which is a fixed around or to an anchor 131 on the armature 126. The trip unit interface surface 128 is once again clearly shown. The cooperation of the armature 126 and its spring 130 as well as the magnetic adjustment dial 117 will be described hereinafter.

Figure 11:
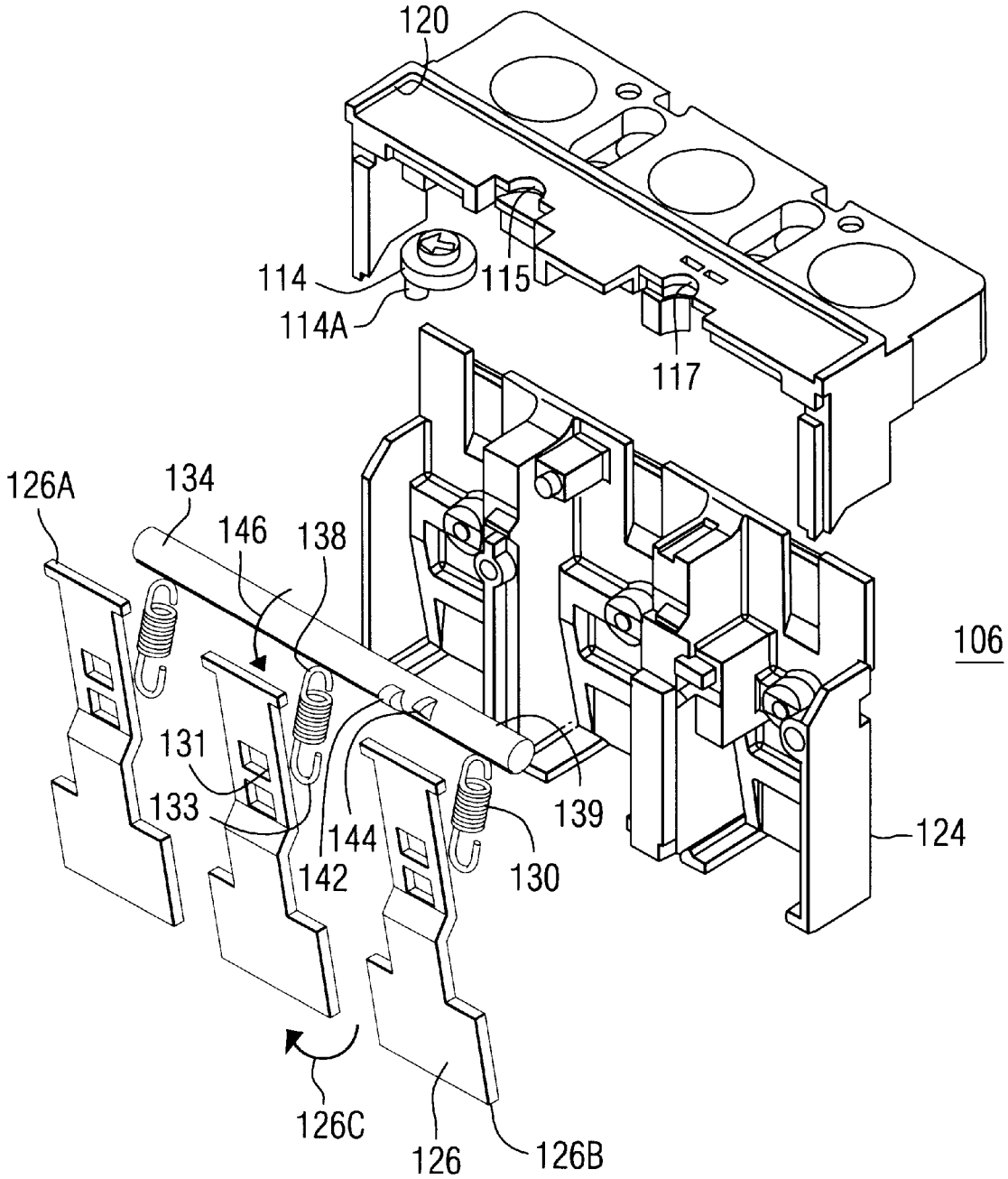
FIG. 11 shows an exploded view of the trip unit portion shown in FIG. 7.

Referring now to FIG. 11, an exploded, orthogonal view of the elements normally disposed within the front portion 106 of the trip unit case 124, is shown. In addition to the cut outs 115 and 117 and the ridge 120, which were clearly described previously, the thermal adjustment dial 114 with its downwardly protruding protrusion 114A is depicted in a separated state from its opening 115. There is provided a magnetic adjustment bar 134 which is fixedly disposed in the portion 106. In particular, magnetic adjustment bar 134 includes a surface mounted cam rider 142 and stop nub 144. The stop nub 144 prevents further rotation of the bar 134 in a direction opposite to the direction 146 and represents the lower limit of adjustment for the magnetic armatures 126. The magnetic armature's springs 130 are shown, including the lower anchor end 133 as separated from the armature anchor 131. Also shown is the upper spring end 138 which is disposable on an anchor 139 on the back of in bar 134 as viewed in FIG. 11. The upper or pivot end 126A of each armature 126 is fixedly disposed for rotation in a seat (not shown) in the upper portion of the front portion 106. This member 126A provides a pivot upon which the armature 126 may rotate. Consequently, the bottom portion 126B of the armature 126 is free to angularly rotate in correspondence with magnetic flux generated by a portion of the trip unit (not shown), in a manner which will be described hereinafter. The resistance to the rotation in response to the magnetic flux is provided by the spring 130. Since the upper spring end 138 is attached to a fixed part 139 of the magnetic adjustment bar 134, rotation of the magnetic adjustment bar 134 in the direction 146 will introduce more tension in the coil spring 130, thus making rotation movement of the end 126B in the direction 126C more difficult or said in another way, requiring a higher level of tripping current and thus providing a higher level of magnetic actuation. The rotation of the magnetic adjustment bar 134 is a function of the location of the cam rider 142 on a cam in the magnetic adjustment dial in a manner to be described hereinafter.

By referring to FIG. 4, once again, it can be seen that in the upper portion of the front portion 106 is disposed the previously described armature seat 126D, in which the armature pivotal upper end 126A is pivotally disposed. Magnetic interaction or force applied to the armature 126 from the left will cause the armature 126 to move in a rotational direction 126C, whereupon a portion of the armature 126 will contact the trip bar magnetic actuation tip 188 and cause tripping action in the circuit breaker, in a manner which will be described hereinafter.

Figure 12:
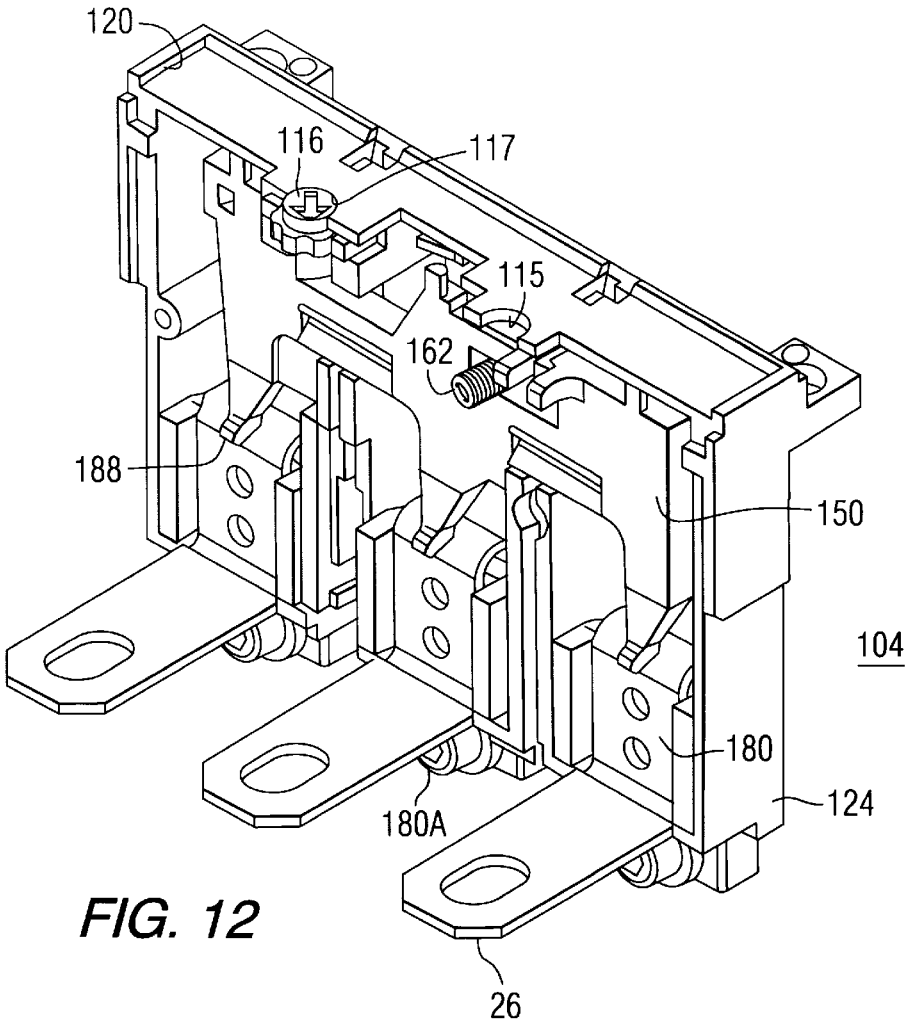
FIG. 12 shows an orthogonal view of the rear portion of the trip unit of FIG. 6 as viewed from the front.
Figure 13:
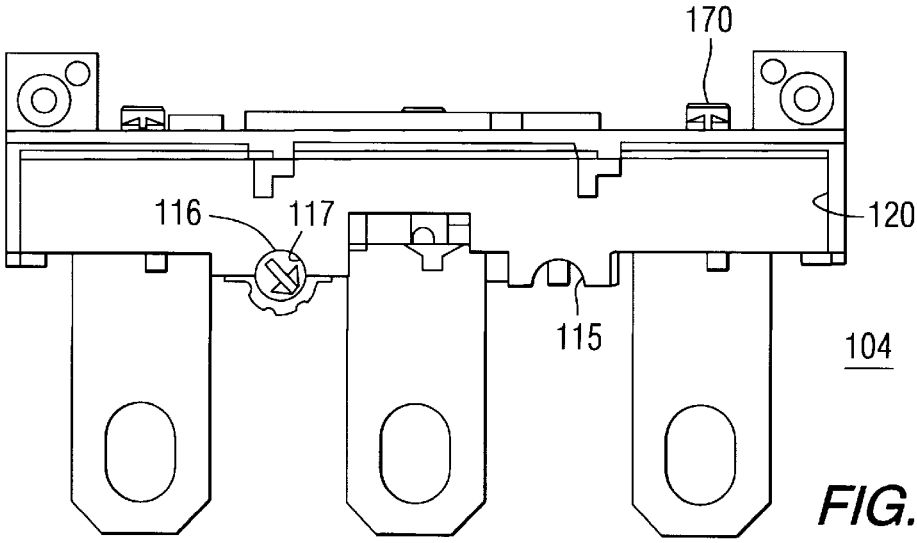
FIG. 13 shows a top view of the portion shown in FIG. 12.

Referring now to FIGS. 12 and 13, as well as FIGS. 1 through 4, the other side or portion or back portion 104 of case 124 of the trip unit 24 is depicted. The load terminals 26 are once again shown. Terminal 26 is shown terminated in an angularly displaced u-shaped bi-metal heater 180 (FIG. 3), which will be described in greater detail hereinafter. One leg of the heater 180 rest in a u-shaped magnetic core 180A. It is this u-shaped magnetic core 180A which becomes magnetized in relationship to the electrical current flowing through the conductor 26 and the heater 180, and which thus draws the lower end 126B of the armature 126 in the direction 126C (FIG. 4) to close the gap between the armature and the face of the magnetic 180A. The magnetic actuation tip 188 of the trip bar 150, which will be described in a greater detail hereinafter, is shown once again. Also shown are the openings 115 and 117. The magnetic adjustment dial 116 is shown in place. Its further construction and use will be described further hereinafter. Once again the raised ridge 120 is depicted. Also shown is the trip plunger driving coil spring 162. Also shown, more clearly in FIG. 13, are trip unit fastening screws 170, the purpose of which will be described in more detail hereinafter.

Figure 14:
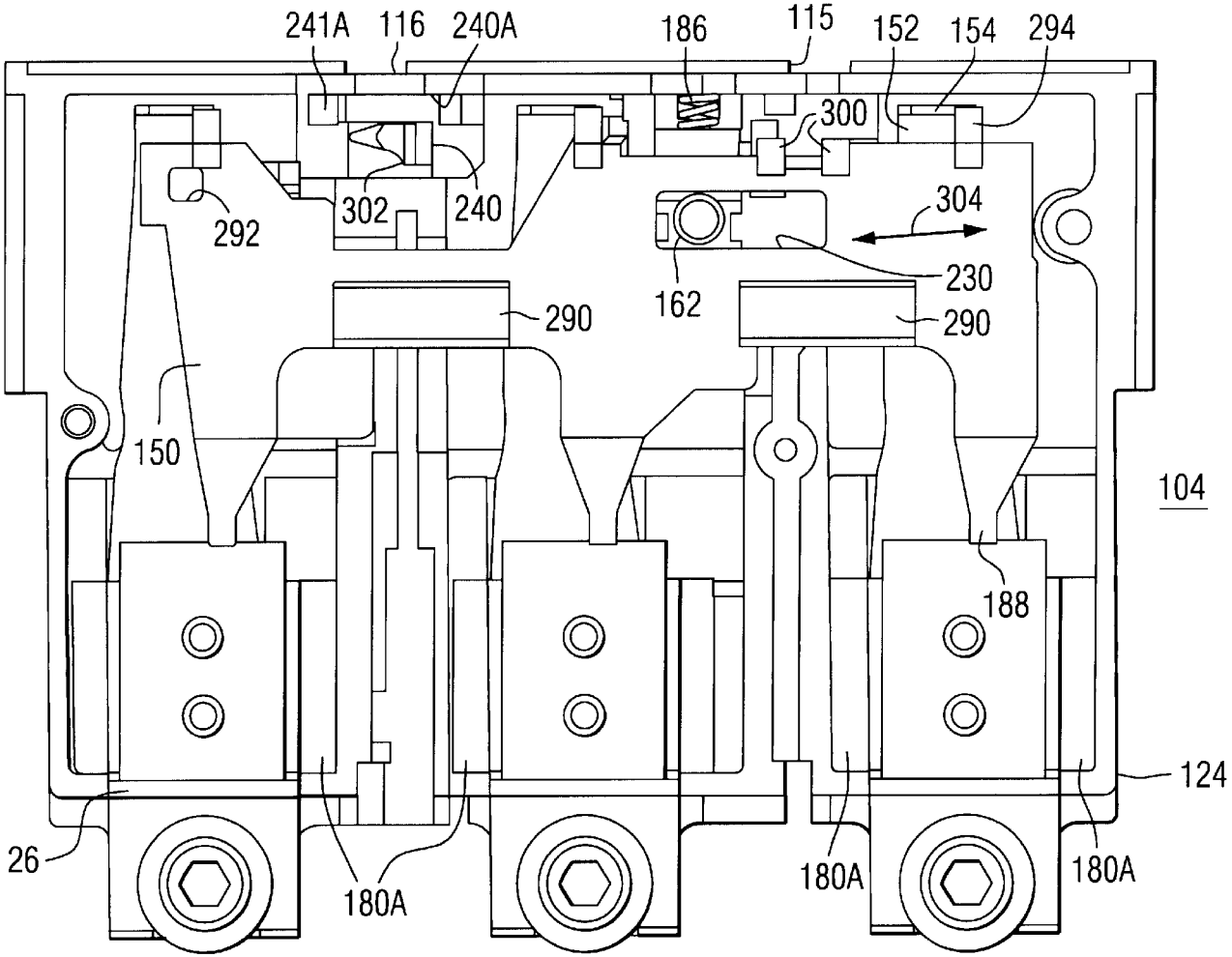
FIG. 14 shows a front view of the portion shown in FIG. 12.

Referring now to FIGS. 10 and 14. The trip unit main body or case 124 is shown once again. Load terminal 26 is once again depicted. The trip bar 150 is shown disposed in the back portion 104 of case 124. The trip bar 150 includes on the bottom thereof the aforementioned magnetic tips 188. Above are shown the thermal actuation tips 294. The trip bar 150 rotates on a pivot at pivot regions 290, the physical pivot is contained in portion 106. The trip bar has disposed therein a trip bar spring opening 230 through which the plunger spring 162 extends in a manner which will be described hereinafter. The trip bar 150 has disposed thereon two trip bar protrusions 300 for capturing a portion of the thermal adjustment member 115 (not shown). Also shown is the trip bar latch spring 186, the purpose of which will be described in greater detail hereinafter. Thermal adjustment member 114 has protruding downward therefrom a thermal adjustment tine 114A (FIG. 10), which is caught on trapped between the aforementioned thermal adjustment protrusions 300 in the trip bar 150. Rotation of the dial 114 will cause the tine to move around a vertical axis, thus forcing the entrapping protrusions 300 to cause the trip bar 150 to move in either direction of thermal adjustment 304. As it does, so the thermal adjustment tip 294 aligns with different regions of the bi-metal trip actuation tip 154 of the bi-metal member 152, in a manner to be described hereinafter for thusly calibrating the thermal trip characteristics. Also shown in FIG. 14 are the magnetic surfaces of the u-shaped magnetic core member 180A. Lastly, there is shown to the left of the trip bar 150 a hole 292, which is a trip bar hole or opening for linking up with a neutral trip bar protrusion for a different embodiment of the invention.

Figure 15:
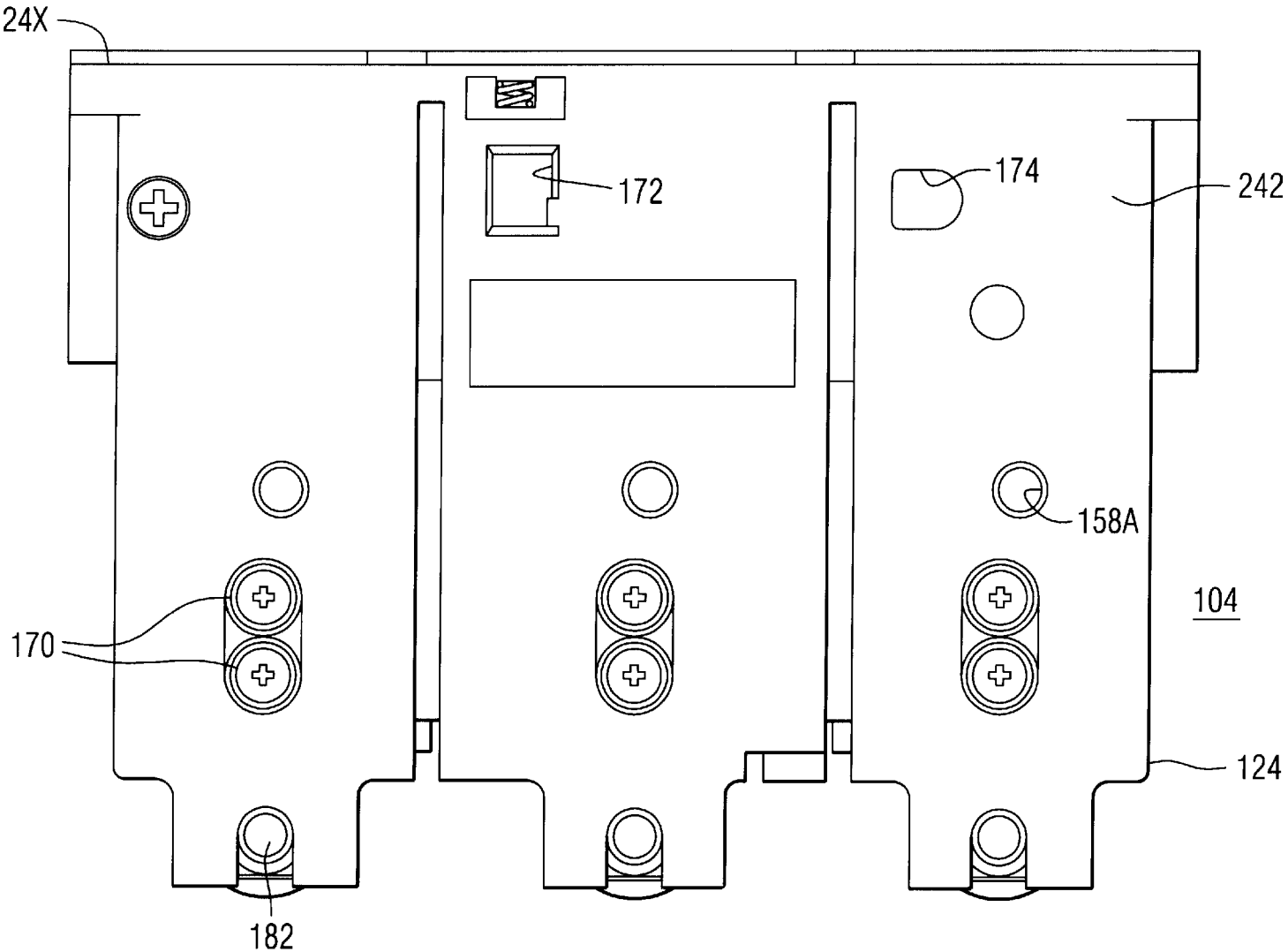
FIG. 15 shows a back view of the portion shown in FIG. 12.

Referring now to FIG. 15, there is shown a rear view of the trip unit back portion 104 of the case 124. The trip unit rear under-lapping lip 24X is depicted. There is also shown a trip unit plunger opening 172 through which the trip unit plunger 74 is driven through the back wall 242 of the casing 124 into the region of the operating mechanism 20, as shown in earlier figures. This will cause a tripping of the primary latch in the manner described previously. The trip unit fastening screws 170 are shown in greater detail as is the trip unit fastening bolt 182, which will also be described in greater detail hereinafter.

Figure 16:
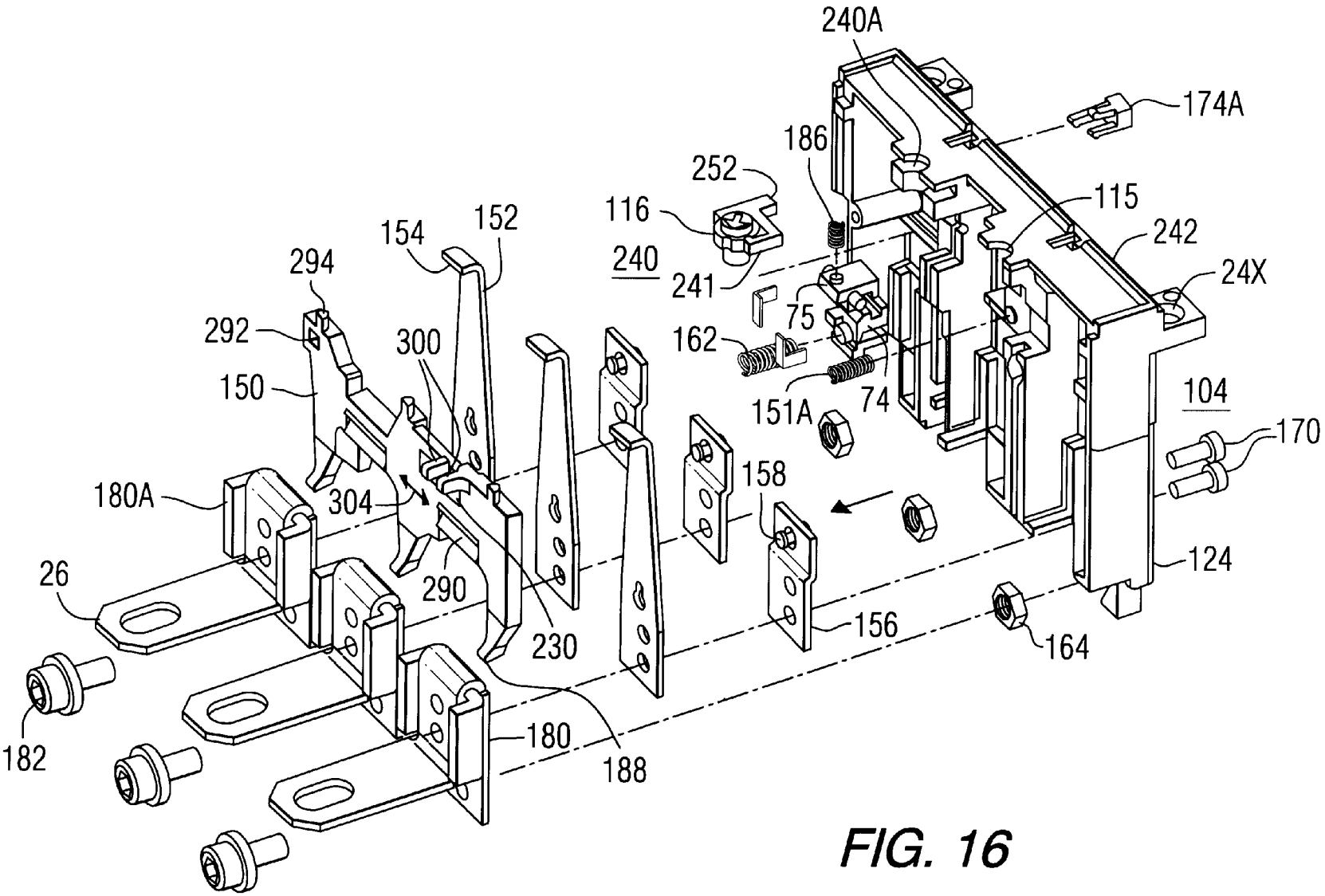
FIG. 16 shows an exploded view of the trip unit portion shown in FIG. 12.

Referring now to FIG. 16, an exploded view of the back portion 104 of case 124 is depicted. Furthest out to the left in FIG. 16 are shown the trip unit securement bolts 182 the use of which will be described hereinafter. These mate with trip unit nuts 164, nuts 164 are deposed in the trip unit case 104 in manner which will be described for joining the bi-metal heater 180 to the case 124. Progressing to the right in FIG. 16, the generally horizontally oriented load terminals 26 are depicted. They terminate on the right in the u-shaped bi-metal heater 180, which in turn surrounds the transversely disposed u-shaped magnetic core 180A. Further to the right is shown the trip bar 150 with its thermal tips 294 and its magnetic tips 188. The trip bar protrusions 300 are clearly depicted as well as the trip bar pivot region 290. Adjustment of the trip bar calibration occurs through dial 114 through tine 114A which proceeds downwardly through the tines 300. This is utilized to slide the trip bar 150 in direction 304 to thus realign the thermal tip 294 with the bias cut bi-metal tips 154 of the bi-metal 152. The opening 292 in the trip bar and the spring opening 230 are clearly shown. The bi-metal tips 154 are bias cut inward from the left to the right as shown in FIG. 16, so that as the tips 154 are moved further to the left, thermal tripping will occur quicker than if the tip 154 is moved further to the right. As the latter occurs the spacing between the bi-metal tip 154 and the thermal tip 294 becomes larger. The bi-metal member 152 is joined on the left to the downwardly protruding side of the bi-metal heater 180 and is sandwiched between that and a bimetal support 156. The entire arrangement is held firmly in the case 124 by way of the aforementioned screws 170, linking up with corresponding holes in the aforementioned elements. The bi-metal strip 152 will be described in more detail hereinafter. For purposes of this discussion, it is sufficient to indicate that there is an adjustment bolt or nut 158 which may be adjusted from the rear thereof for changing the initial disposition of the bi-metal tips 154 with respect thermal tip 294 for initial calibration of the thermal magnetic tripping characteristics of the circuit breaker. The trip plunger driving coil spring 162 is clearly shown, as is the trip bar bias spring 151A which must contact the trip bar 150 below the pivot regions 290, as shown in FIG. 16. Also shown is the cam indicator assembly 240, which contains as part thereof the dial 116 which protrudes through the opening 117. This arrangement will be described in greater detail hereinafter. Also shown is the plunger 74 and latch 75 therefore, which will also be described in greater detail hereinafter. The driving spring for the latch 75 is depicted at 186. Opening 115 is also depicted in the case 124. Lastly, there is shown an accessory plunger 174A which interacts through the accessory plunger opening 174 as shown in FIG. 15. This is to cause tripping of the circuit breaker by way of accessory region activity.

Figure 17:
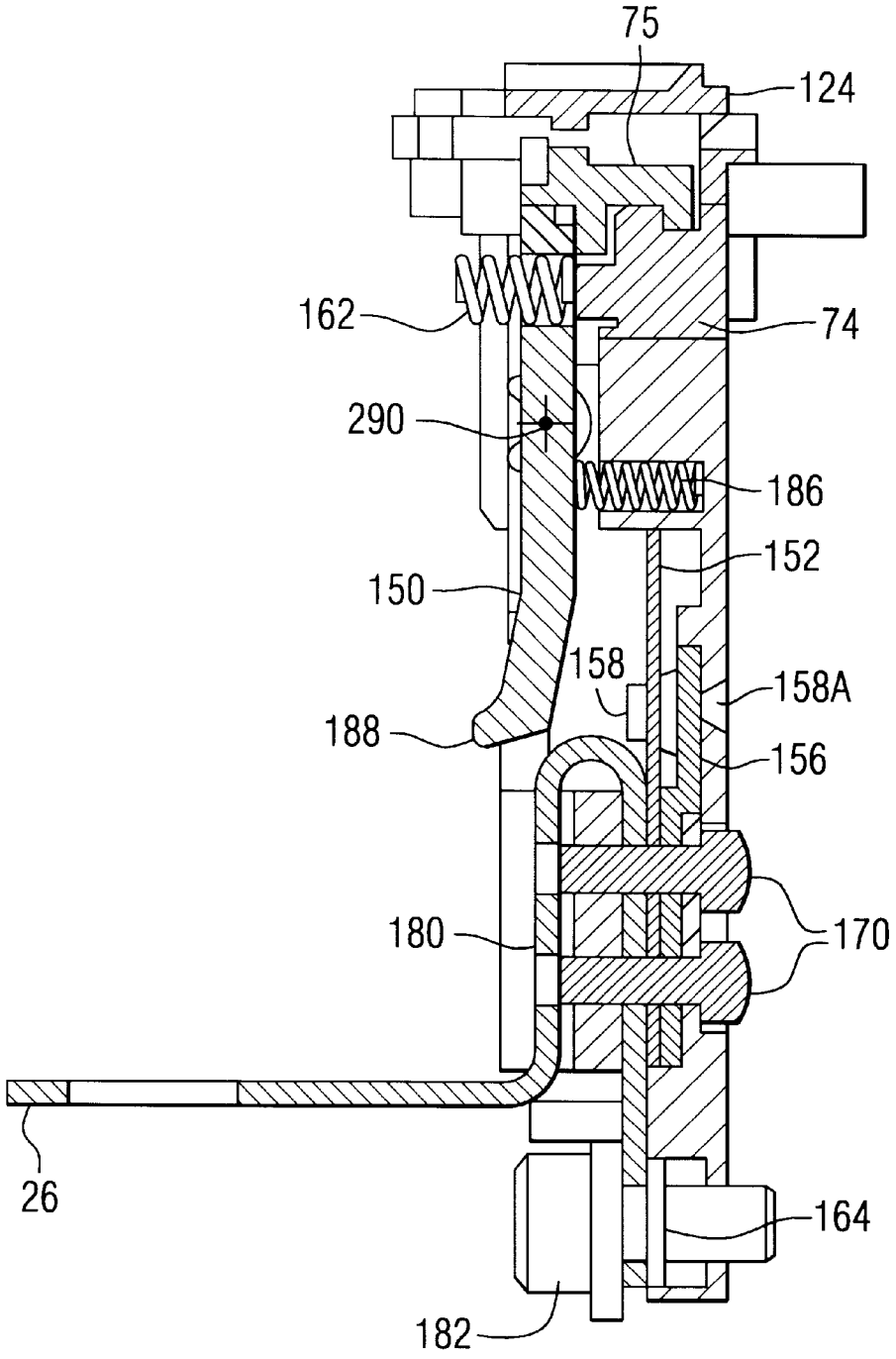
FIG. 17 shows a side elevation, partially broken away and partially in a cross-section of the trip unit portion shown in FIGS. 11 through 16.
Figure 18:
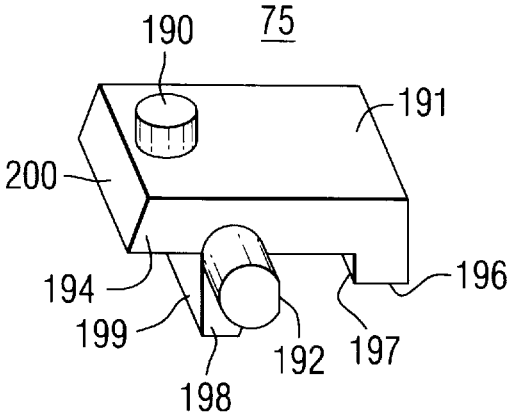
FIG. 18 shows an orthogonal view of the trip unit trip plunger latch.
Figure 19:
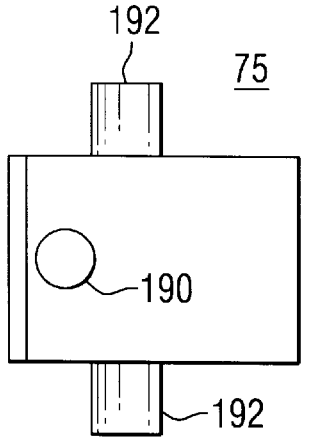
FIG. 19 shows a top view of the latch depicted in FIG. 18.
Figure 20:
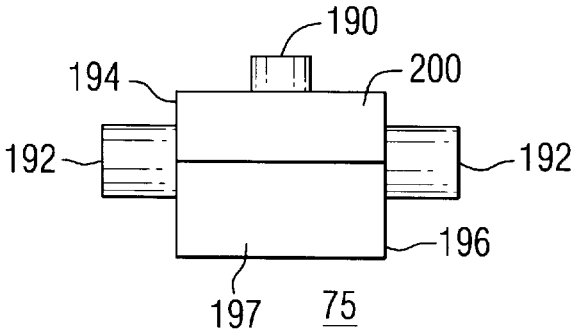
FIG. 20 shows a front view of the latch depicted in FIG. 18.

Referring now to FIG. 17, a more detailed view a portion of the trip unit 24 and bi-metal 52 is depicted. In particular the trip bar 150 is shown depicted with its pivot region 290 clearly indicated. In this case the trip bar magnetic actuation tip 188 is shown protruding to the left in the figure. Clearly shown is the interaction of the trip unit screws 170 with the case 124, the bi-metal support bar 156, the bi-metal 152 and the u-shaped heater portion 180, which is lastly attached to the load terminal 26. Disposed between the bi-metal 152 and an off-set portion of the bi-metal support 156 is a bi-metal adjustment screw 158 which may be accessed from the rear of the casing 124 at 158A. In this embodiment of the invention, trip bar spring 186 is shown seated on the right case 124 and loaded against the trip bar 150 at a region below the trip axis of rotation 290. The nut and bolt arrangement 182 and 164 respectively for securing a portion of the heater 180 to the casing 124 is depicted once again.

Figure 21:
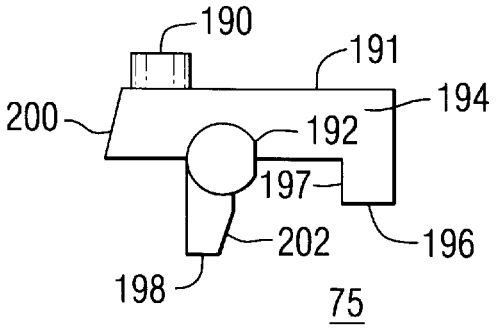
FIG. 21 shows a right side elevation of the latch depicted in FIG. 18.
Figure 22:
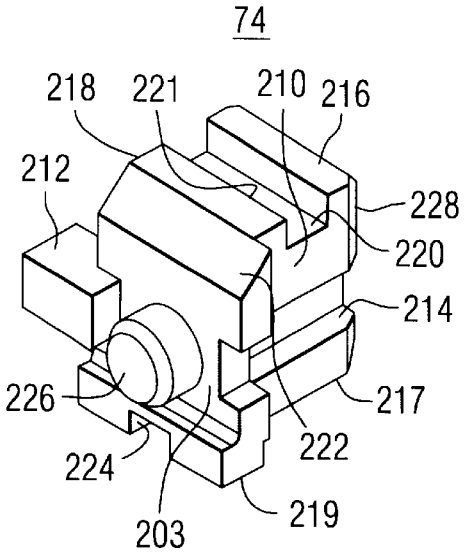
FIG. 22 shows an orthogonal view of the trip unit trip plunger.

Referring now to FIGS. 18 through 21, the construction features of the trip unit trip plunger latch or interface latch 75 are shown and described. In particular, there is provided a trip unit latch main body 194 having a trip unit latch top surface 191, upon which is disposed a spring seat 190, to which is fix the bottom of the trip bar coil spring 186 (not shown). There are provided on either side, two pivot cylinders or axis 192, upon which the element 75 rotates under the influence of the spring 186 and other forces. There is a first or front downward protrusion 198 having an abutment surface 199 on the bottom thereof. There is also a second or rear downwardly protruding latch protrusion member 196 having a latch surface 197 on an inner vertical portion thereof. On the front of the main body 194 is a disposed a beveled face 200. Also shown in FIG. 21 is a second beveled face 202 on the rear portion of the first downward protrusion 198.

Figure 23:
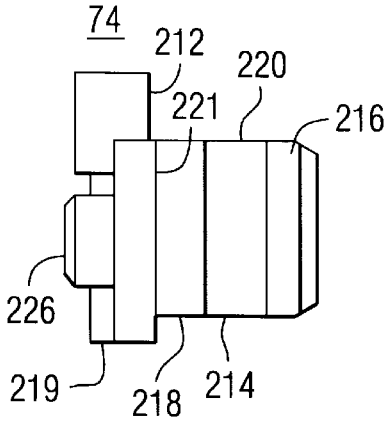
FIG. 23 shows a top view of the plunger depicted in FIG. 22.
Figure 24:
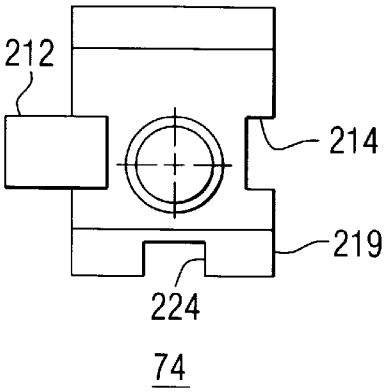
FIG. 24 shows a front view of the plunger depicted in FIG. 22.
Figure 25:
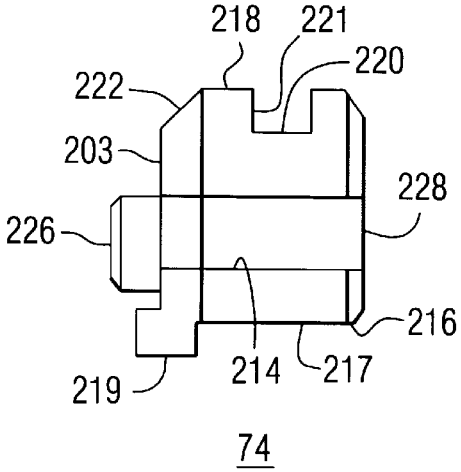
FIG. 25 shows a right side view of the plunger depicted in FIG. 22.

Referring now to FIGS. 22 through 25, the trip unit plunger 74 is depicted. Plunger 74 has a main body 210 having a front surface 203 and protruding from the left side thereof as shown in FIG. 24, for example, a left side guide protrusion 212 and on the right, a right side guide groove 214. As best shown in FIG. 25 there is a plunger top rear protrusion 216 and lower main body bottom protrusion 217. Disposed on top of the main body is a trip unit plunger top front protrusion 218 and below that on the bottom a bottom front protrusion 219. A trip unit plunger latch groove 220 exist between the two upward protrusions 216 and 218. The plunger has a latching surface 221 and a beveled front face 222 between the front surface 203 and first top portion 218. There is also a bottom guide groove 224, best shown in FIG. 24. Also depicted is a plunger coil spring seat 226 on which is seated one end of the spring 162. There is an operating mechanism tripping face 228 on the right portion of the plunger as shown in FIGS. 23 and 25, for example.

Figure 26:
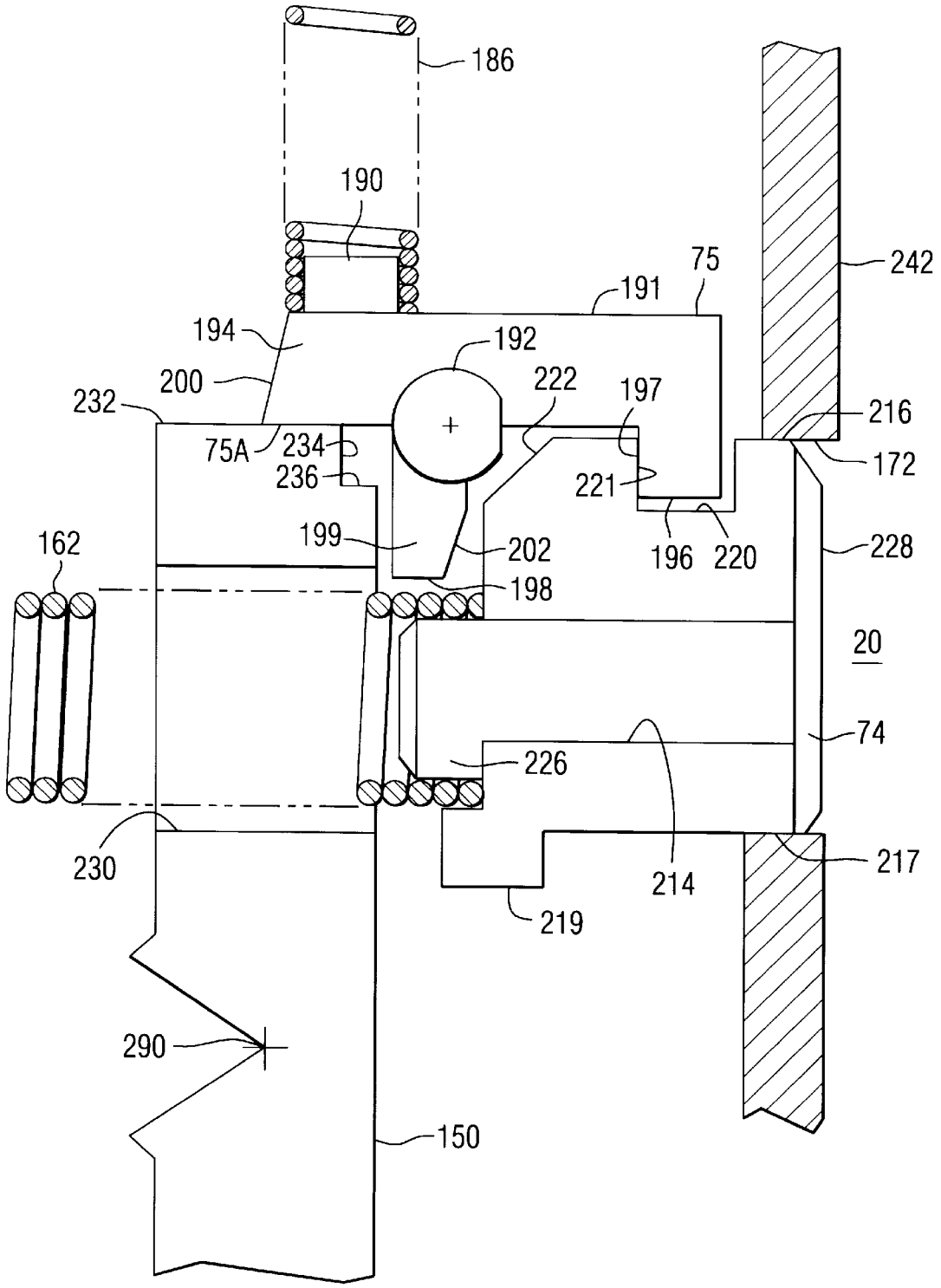
FIG. 26 is a side view, partially broken away and partially in section, of that portion of the trip unit depicting the cooperation of the trip unit latch and plunger of FIGS. 18 through 25 in a latched state.
Figure 27:
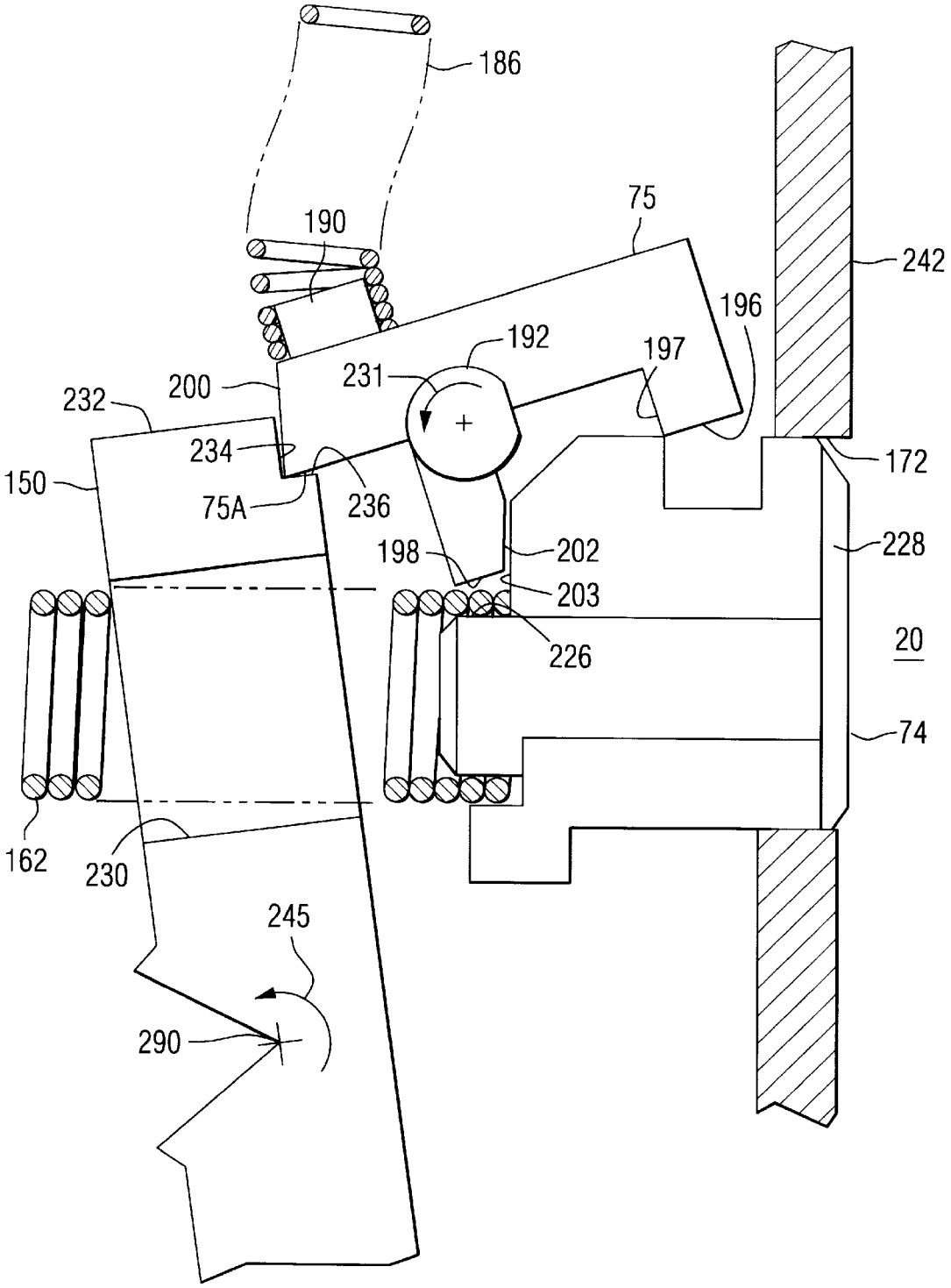
FIG. 27 shows a view similar to FIG. 26, where the latch has begun to release and the plunger has begun to move.
Figure 28:
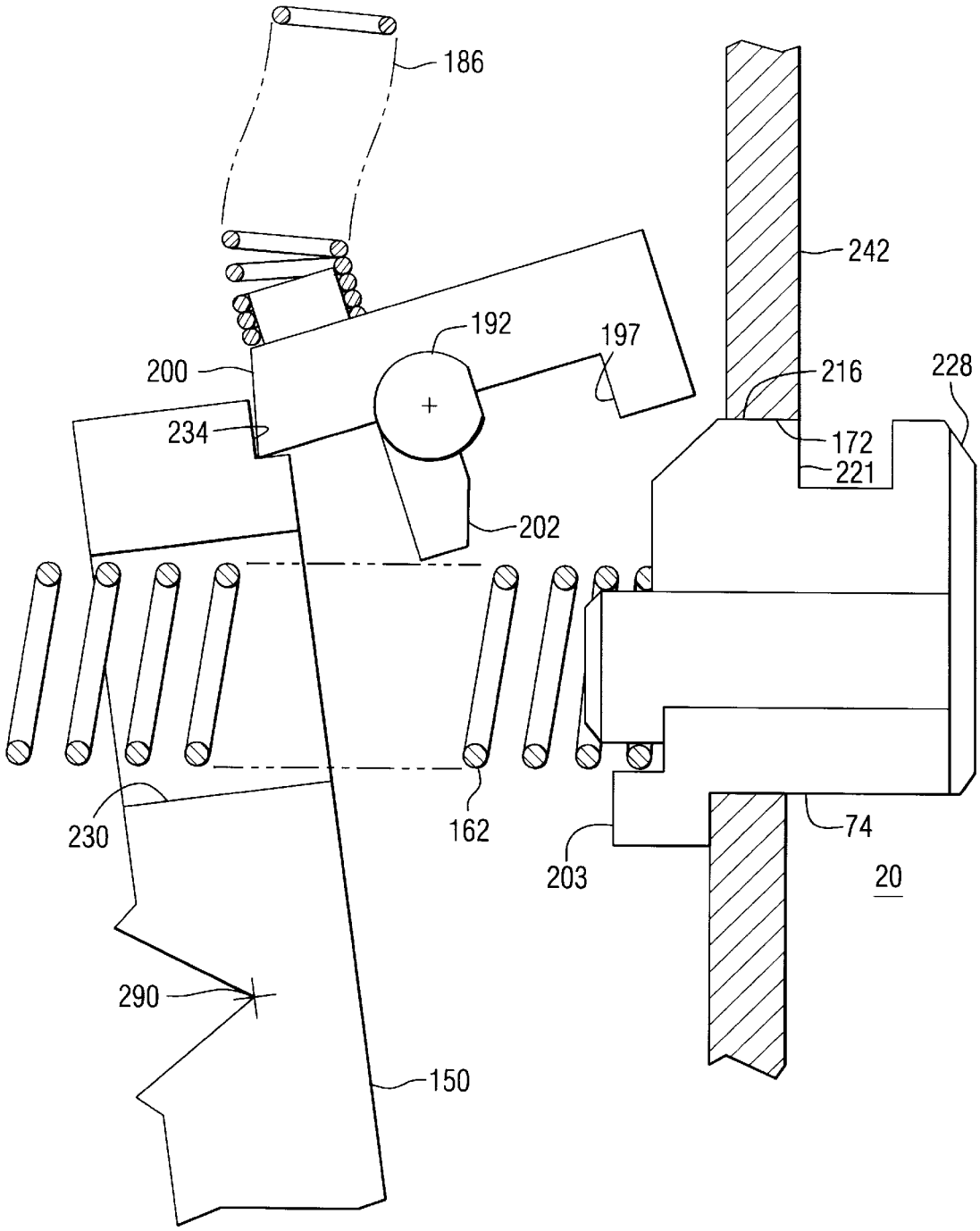
FIG. 28 shows a view similar to that of FIGS. 26 and 27, where the latch is completely disengaged and the plunger has moved to its final position.

Referring now to FIGS. 26 through 28, the interaction of the latch member 75 and the plunger 74 is depicted. Also shown is the rear wall 242 of the trip unit 24 and a portion of the trip bar 150. Trip bar 150 has its pivot at 290. Trip bar 150 has an opening therein 230 sufficiently large to accommodate or pass the spring 162 in various modes of trip bar orientation. Spring 162 is seated against spring seat 126. The varied guide protrusions and guide grooves 112, 114 and 124, for example, fit slidingly into complimentary portions of the frame casing 124. When unlatched the plunger 74 is free to move slidingly to the right under the influence of the spring 162, through the opening 172 into the region of the operating mechanism 20, for causing a tripping action. The plunger latch 75 is shown in FIG. 26 in a disposition of latching. In particular, the plunger latch is rotationally seated at pivot 192 for rotation there about. The plunger latch spring 186 bears down against the top of the plunger latch 191 around the seat 190 to maintain the bottom left portion 75A (as view in FIG. 26) of the latch 75 against the top surface 232 of the trip bar 150. In such an arrangement, the trip unit plunger latching surface 221 is snuggly latched against the downward protrusion latch surface 197 of the latch 75. Thus the plunger 74 is prevented from moving to the right. The face portion 228 of the plunger 74 is maintained in sliding relationship against the surfaces 172 of the back wall 142 at sliding surfaces 216 and 217 of the plunger 74.

Referring to FIG. 27, as the trip bar 150 is rotated about its axis 290 in the direction 245, which is a first direction of rotation, the spring 162 acting through the opening 230 exerts pressure against the back wall 203 of the plunger 74. Once the upper surface 232 of the trip bar 150 clears the bottom portion 75A of the latch, the latch 75 is free to rotate downwardly in the direction 231 about the axis 192 under the influence of the spring 186 to slidingly abut the vertical wall 234 of the trip bar 150 with the front beveled surface 200 of the latch 75. As this happens, lower front member 198 of the latch 75 protrudes or rotates to the right. The beveled portion 202 may provide an assist region for pushing the member 74 in the rightward direction. Of greater importance, in the resetting operation when the member 75 is pushed to the left by actions within the operating mechanism 20, the surface 203 thereof makes contact with the surface 202 thus rotating member 75 in the counter direction of 231 against the action of the spring 186 until the beveled surface 200 clears surface 234 and allows the upper surface 232 of the trip bar 150 to more to the right as the trip bar spring (not shown) forces the trip bar to rotate in the counter direction of 245 on its axis 290 to the right as shown in FIG. 27. However, for purposes of describing the movement of member 74 to the right, the bottom of the front of the latch 75 abuts against a flat surface 236 of the trip bar 150, thus preventing further movement of the latch 75 in the rotational direction 231.

Referring to FIG. 28, this time, sliding surfaces 197 and 221 of the latch 75 and plunger 74 respectively are cleared and the forceful action of the spring 162 causes the plunger 228 to be forcefully moved to the right such for initiating a tripping action. The plunger 74 remains in this disposition until a reset operation has begun from the right as viewed in FIG. 28 by activity in the operating mechanism 20. This activity will move the plunger 74 to left from the orientation shown in FIG. 28 to the orientation shown in FIG. 27 and finally to the orientation shown in FIG. 26, which represents a completely reset disposition of the plunger mechanism 74 with its latch member 75.

Figure 29:
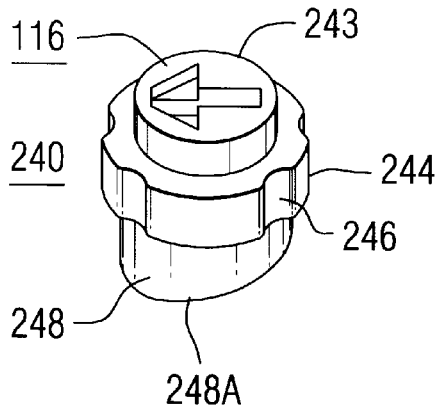
FIG. 29 is an orthogonal view of the magnetic adjustment dial for the trip unit of FIG. 6.
Figure 30:
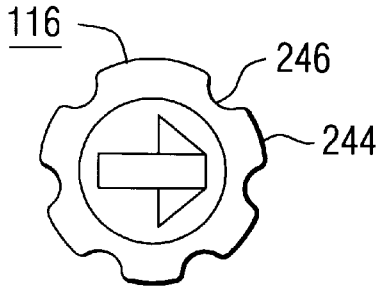
FIG. 30 is a top view of the dial of FIG. 29.

Referring now to FIGS. 11, 16 and 29 through 31, portions of the adjustable cam indicator assembly 240 for the magnetic trip dial 116 are depicted. Assembly 240 includes a cam indicator flexible stop member 241 and cam indicator dial 116. In particular, cam indicator dial 116 includes a rotatable cam indicator dial face 243 disposed above a cam indicator registered surface 244 in which are disposed cam indicator registers or detents 246. Below this is disposed the cam cylinder 248 on the bottom of which is disposed the camming surface 248A, which faces downwardly from the cam cylinder 248. Surface 248A slopes anglarly downwardly around the cam cylinder 248 from a position very near the registered surface region 244 to a position at the full extent of the cam cylinder 248. It is against this surface that the cam rider 142 of adjustment bar 134 of FIG. 11 is loaded by way of the spring action in the springs 130 acting against the magnetic adjustment bar 134. Therefore, as the cylinder cam 248 is rotated in a clockwise direction to the right as shown in FIG. 29, the cam rider of FIG. 11 is forced downwardly, thus causing the magnetic adjustment bar 134 to rotate in the direction 146. Rotation in the direction 146 causes the springs 130 to tense or extend thus calibrating the movement of the armature 126 towards the armature plates 180A as shown in FIG. 16 in response to increasing higher levels of overload current in the conductor 26.

Figure 31:
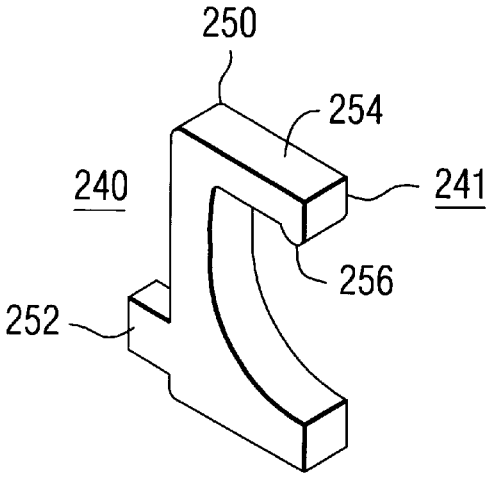
FIG. 31 is an orthogonal view of the cam indicator flexible stop member for utilization with the magnetic adjustment dial of FIGS. 29 and 30.
Figure 32:
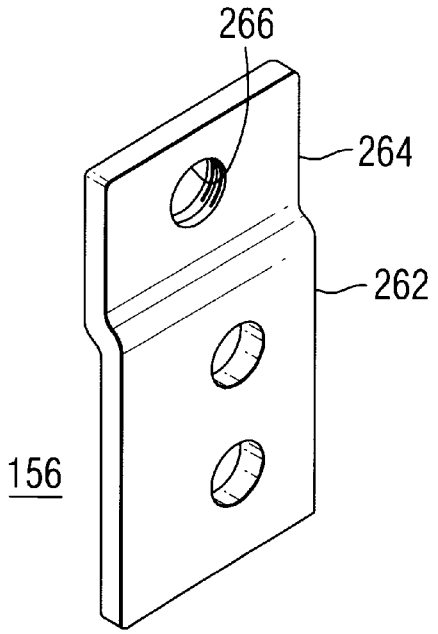
FIG. 32 shows an orthogonal view of a bi-metal and adjustment member support bar for a thick metal embodiment.
Figure 33:
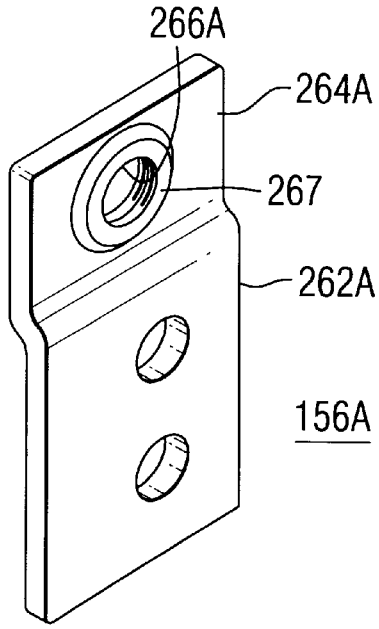
FIG. 33 shows a view similar to FIG. 32, but for a thin metal embodiment.
Figure 34:
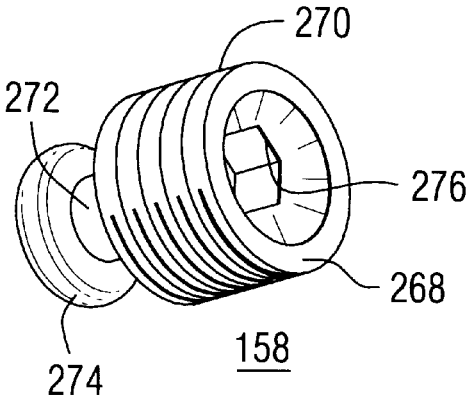
FIG. 34 shows an orthogonal view of a moveable bi-metal adjustment member.
Figure 35:
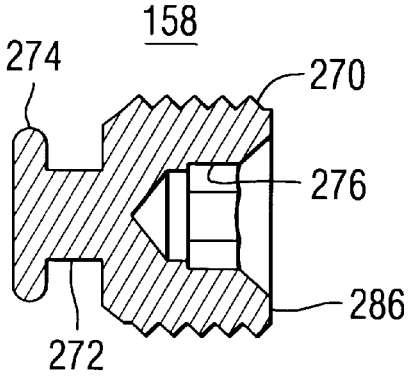
FIG. 35 shows a side sectional view of the adjustment member of FIG. 34.
Figure 36:
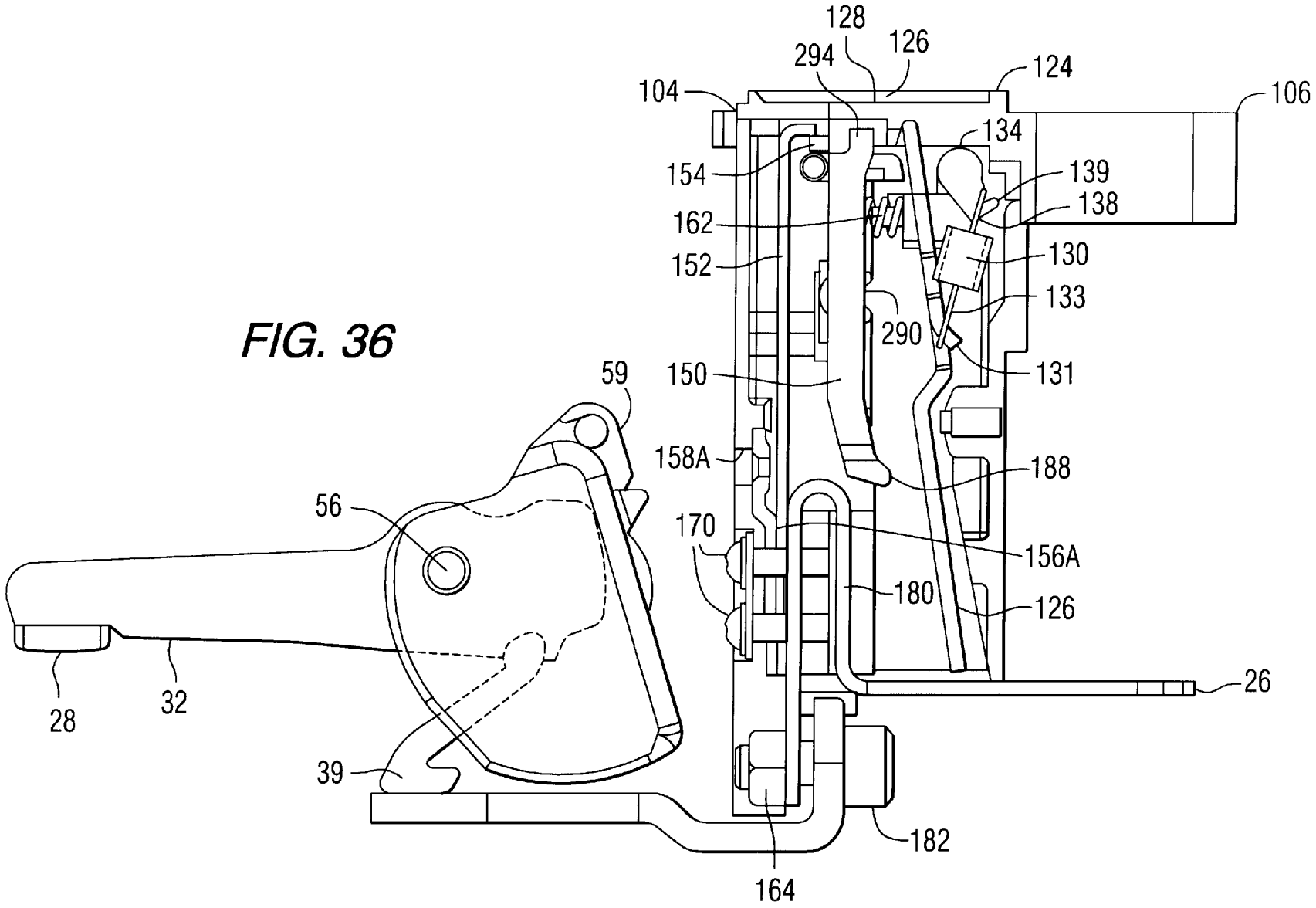
FIG. 36 shows a depiction of a completely assembled trip unit in side elevation partially broken away and partially in section, concentrating on the conductor fastener arrangement.

FIGS. 14, 16 and 31 show the main body 250 of the cam indicator stop member 241. There is provided a flexible arm 254 which terminals inwardly at one end thereof in a register stop nub or protrusion 256. Arm 254 may be viewed as a center span with two ends, one end which terminals in the nub 256 and the other end which terminals in a main body 250. The other end of the main body 250 has disposed thereon a flexible stop member locator nub 252, which conveniently fits into an opening 241A in the back of the grooved seat 240A shown in FIGS. 14 and 16. In an embodiment of the invention, registered surface 244 of member 116 fits into member 241 to form the assembly 240 as shown in FIG. 16. Rotation of the dial 243 causes the register surface to rotate against the nub 256 until a detent or register 246 is reached in which case the flexible arm 254 flexes the nub 256 into the register or detent 246 thus locking a discrete position of the magnetic adjust member into place. Member 241 thus provides two functions in a single unit. First, it is the support member for the rotating dial 243, and second, it also provides the register operation therefore. The locator nub 252 operates to prevent the member 241 from being inserted incorrectly into or in the reversed direction in the grooved seat 240A for the member 240.

Referring now to FIGS. 17 and 32 through 36, the construction and operation of the bi-metal member 152 in conjunction with its support member 156 and the trip bar 150 is set forth. In particular in FIGS. 32 and 33, alternate embodiments are shown of the bi-metal and adjustment member support bar for a thick metal embodiment, as shown in 156 and for a thin metal embodiment as shown in 156A. In either case there is provided a main body 262 or 262A, respectively, having support bar parallel longitudinal offset members 264 and 264A, respectively. Offset 264 has disposed therein a threaded hole 266 and offset 264A has raised ridge 267 surrounding a threaded hole 266A. Screwable into either of the threaded holes 266 or 266A is a moveable bi-metal adjustment or calibration member or bolt 158. Bolt 158 includes a main body 268, which may be cylindrical, having a bi-metal contact nub 274 and disposed therebetween a bi-metal capture neck 272. The threads on the main body member 268 are depicted at 270. Neck 272 protrudes outwardly rearwardly and to the left in FIG. 17, for example, to have captured thereon the bi-metal strip 152. Consequently, rotation of the calibration member 158 by way of drive hole 276 from the rear wall of the trip unit case 174 through opening 158A will cause the bi-metal 152 to initially flex either to the left or to the right thus causing the tip 154 to move closer to or further away, respectively, from the trip bar thermal actuation tip 294 on the trip bar 150. This will cause the trip bar to rotate clockwise or to the right on a pivot 290 as the bi-metal tip 154 strikes and pushes in a rotating manner the tip 294 of the trip bar 150. This will lead to the tripping operation described previously with respect to the latch 74 and plunger 75.

Figure 37:
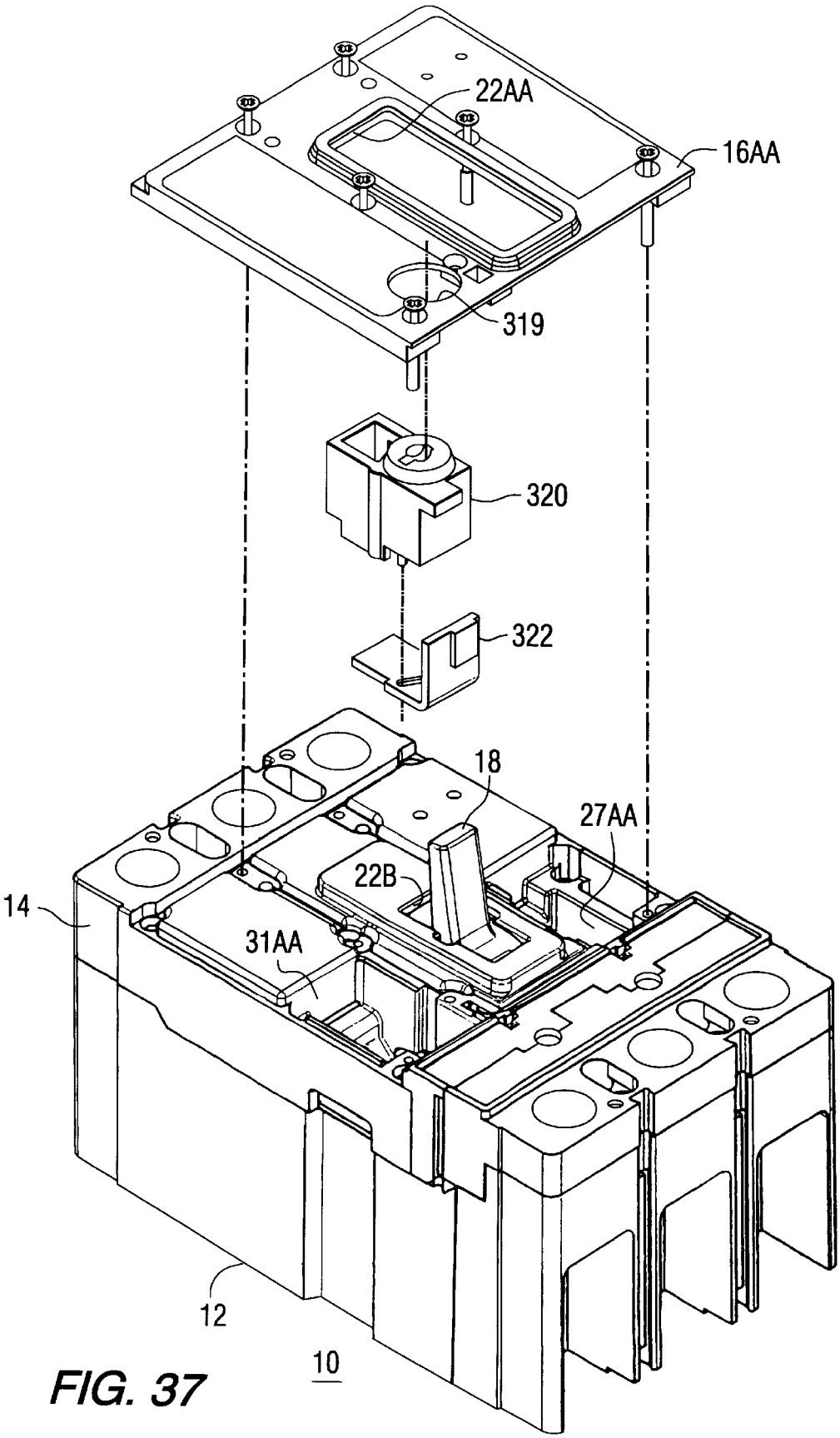
FIG. 37 shows a three-pole molded case circuit breaker, similar to that shown in FIG. 1 with the primary cover removed and locking arrangement of the present invention shown in exploded disposition.
Figure 43:
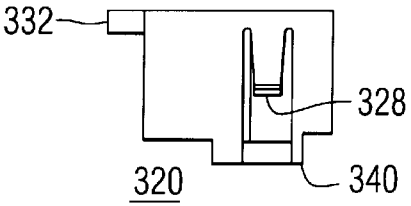
FIG. 43 shows a left side view of the cylinder lock member of FIG. 38.
Figure 38:
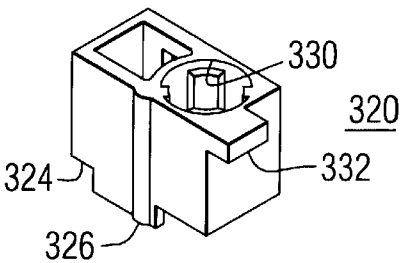
FIG. 38 shows of an orthogonal view a cylinder lock member embodying the present invention.
Figure 42:
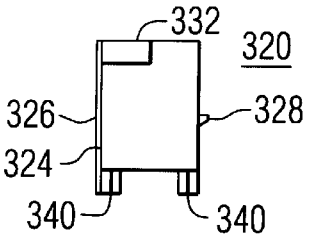
FIG. 42 shows a front view of the cylinder lock member of FIG. 38.
Figure 39:
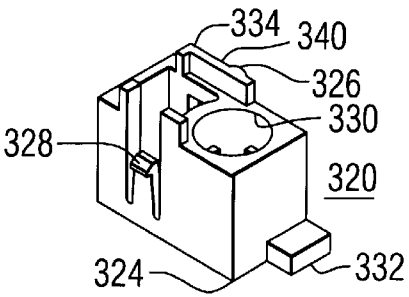
FIG. 39 shows the cylinder lock member of FIG. 38 in upside-down orthogonal view.
Figure 41:
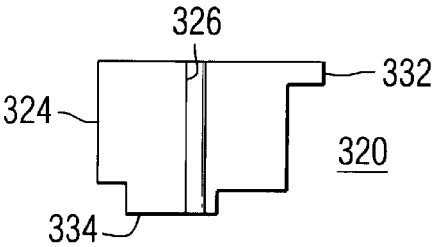
FIG. 41 shows a right side view of the cylinder lock member of FIG. 38.
Figure 40:
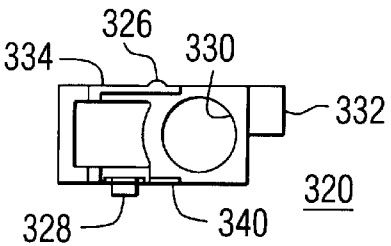
FIG. 40 shows a bottom view of the cylinder lock member of FIG. 38.

Referring now to FIGS. 37 through 47, a locking embodiment of the invention is shown. In particular, FIG. 37 shows the circuit breaker 10 with its secondary cover 16AA disposed in an exploded disposition above the primary cover 14 on the base 12. The secondary base escutcheon 22M and the primary base escutcheon 22BB are shown as is the handle 18. In the left portion of the secondary cover 16AA towards the front is a lock opening 319, which interacts with cylindrical locking member 320 and cylindrical locking auxiliary member 322 in a manner to be described hereinafter. Cylindrical locking member 320 comprises a main body 324 with left placement guide protrusion 326 on the left side thereof and right snap tab attachment member 328 on the right side thereof. There is an opening 330 for containing a lock barrel in a manner which will be described hereinafter. There is a protrusion 332 on the upper right front, and left and right support lips 340 on the bottom main body 324.

Figure 44:
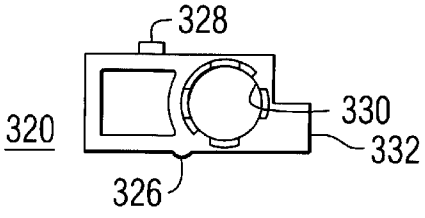
FIG. 44 shows a top view of the cylinder lock member of FIG. 38.
Figure 44A:
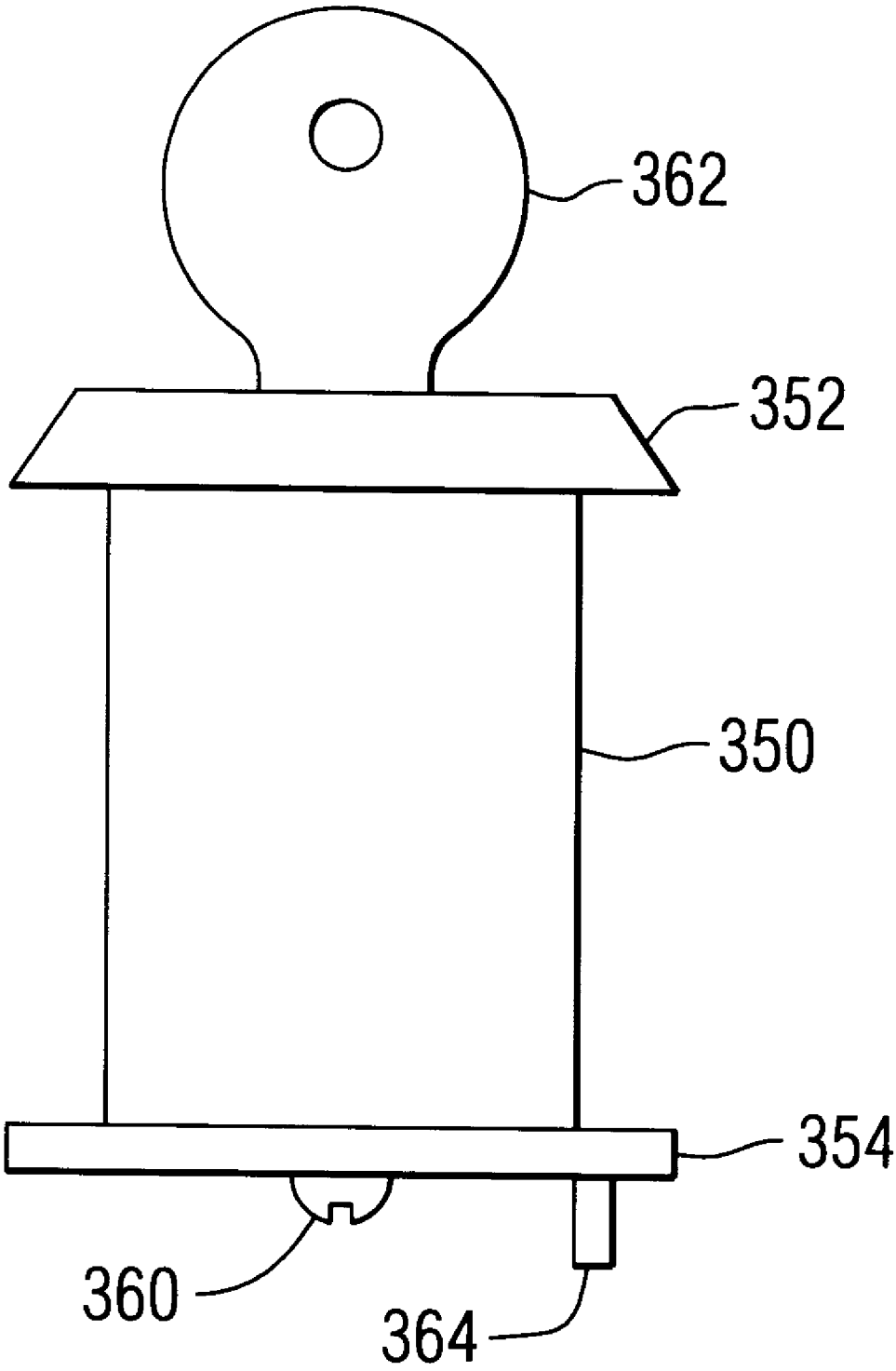
FIG. 44A shows a side elevation of the internal cylinder lock for the cylinder lock member of FIG. 38.

In FIG. 44A there is provided a key lock arrangement with cylindrical lock body 350 suitable for placement into the opening 330 described previously. There is also an upper stationary flange 352 disposed on the top of the cylindrical lock body or barrel 350 and a lower rotating flange 354 on the bottom thereof. When assembled the upper flange 352 bears downwardly against the top portion of the main body 320 and the lower flange 354 rotates slidingly against the bottom portion thereof. The lower rotating flange 354 is attached to the barrel member 350 by way of an attachment bolt or screw 360. There may be provided a key 362 for rotational movement of the lower rotational flange member 354. There is depending downwardly from the bottom of the lower rotational flange or flex member 354 a lock protrusion 364.

Figure 45:
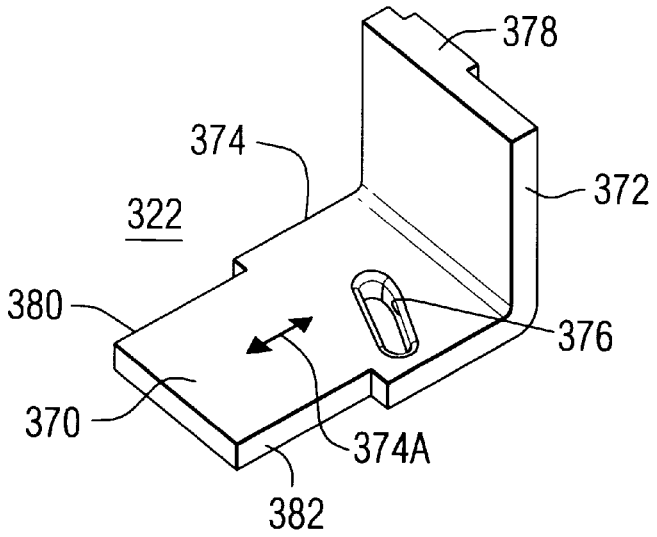
FIG. 45 shows an orthogonal view of the cylinder lock auxiliary member utilized with the apparatus of FIGS. 37 through 44.
Figure 46:
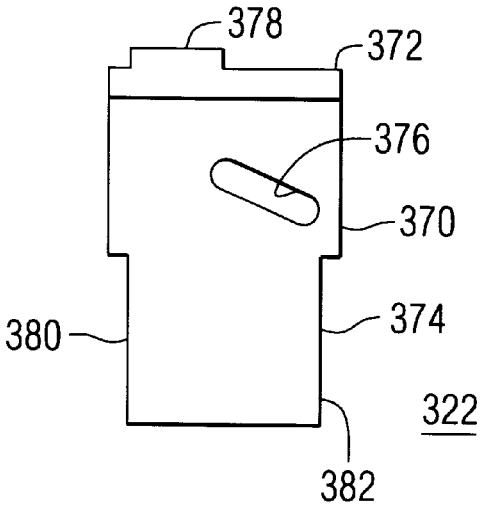
FIG. 46 shows a top view of the member of FIG. 45.
Figure 47:
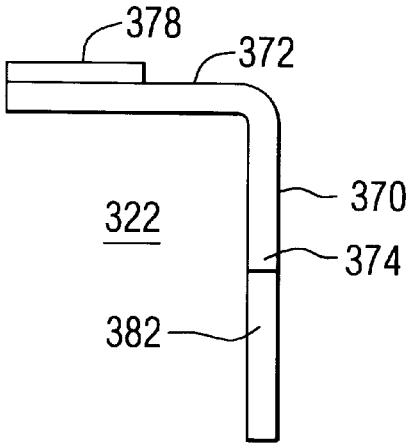
FIG. 47 shows a right side view of the member of FIG. 45.

Depicted in FIGS. 15, 16 and 45 through 47 and also shown in FIG. 37 is a cylindrical lock auxiliary member main body 370. This main body 370 has a vertical extension 372 and a horizontal extension 374 extending at right angles relative to each other. There is a lower rotating flange protrusion complimentary opening 376 adapted to capture the downward facing lock protrusion 364 of the lock barrel 350. There is also provided an accessory trip surface 378. There are, at the ends of either side of the horizontal extension 374, cutouts 380 and 382. When assembled together the bottom extensions 334 of the cylindrical lock member 320 straddle the extension 374 at the cutouts 380 and 382. At this point the lock protrusion 364 fits downwardly into and mates with lower rotating flange protrusion complimentary opening 376. If the key 362 is turned, thus rotating the lower rotational flange 354, the lock protrusion 364 will move within the complimentary member 376 causing the auxiliary member 322 to move to the right as shown in FIG. 45. Member 322 can neither rotate nor move in any other direction but backwardly and forwardly along line 374A when it is installed in the accessory pocket or region 31M. As the surface 378 moves within the enclosure 31AA under rotational movement of the key 362, it eventually makes contact with the accessory trip plunger 174A (see FIG. 16) at the back wall 242 of the trip unit 24 causing the plunger 174 to move inwardly of its guide hole or opening 174 (see FIG. 15) to impinge upon a portion of the trip bar 150 to cause rotational tripping movement thereof, as described previously to cause a subsequent trip of the circuit breaker mechanism 20 through the operation of the plunger and latch arrangement 74 and 75, respectively.

It can be seen therefore that circuit breaker may be tripped by utilizing the key 362, the arrangement 320–322 operating back into the trip unit 24 through the member 174 through the trip bar 150, through movable trip unit member 74 and back into the operating mechanism 20 from that removable trip unit member 74. Once the key has been rotated to cause this locking, the trip unit member 24 will remain latched closed until reset in the manner previously described. The key 362 can be removed at this point, thus guaranteeing that the circuit breaker can not be reset because a reset would necessitate a rotating of the trip bar 150 backwards, which is prevented by the engagement of the member 174A therewith. The device can not be reset until the member 174A can be driven backwards into the region 31AA. This can not happen as long as the key lock arrangement 320–322 remains locked.

What we claim as our invention is:

1. A circuit interrupter device, comprising:

a housing means having an auxiliary device compartment therein;

an operating mechanism means disposed in said housing means;

a separable contact means disposed in said housing means having two contacts which are structured to open;

said operating mechanism means coupled to and structured to open said separable contact means a triggerable tripping means disposed in said housing means and coupled to said operating mechanism means;

said triggerable tripping means structured to actuate said operating mechanism means for opening said separable contact means;

a triggering means having a forward position and a backward position disposed in said housing means and accessible from said auxiliary device compartment;

said triggering means coupled to said triggerable tripping means;

said triggering means structured to trigger said triggerable tripping means to actuate said operating mechanism means for opening said separable contact means when said triggering means is in said forward position; and a locking means disposed in said auxiliary device compartment in said housing means;

said locking means having a locked and unlocked position;

said locking means structured to engage said triggering means while said locking means is in said locked position and maintain said triggering means in said forward position.

2. The combination as claimed in claim 1, wherein said housing means comprises a primary cover means, said auxiliary device compartment being disposed in said primary cover means.

3. The combination as claimed in claim 2, wherein said housing means comprises a secondary cover means, said auxiliary device compartment being disposed in said primary cover means under said secondary cover means.

4. The combination as claimed in claim 3, wherein said secondary cover means has an opening therein adjacent said locking means for insertion of a key into said locking means from a region outside of said secondary cover means for actuating said locking means.

5. A circuit interrupter, comprising:

a housing means having an auxiliary device compartment therein;

an operating mechanism means disposed in said housing means;

a separable contact means disposed in said housing means having two contacts which are structured to open;

said operating mechanism coupled to and structured to open said separable contact means a latchable tripping means disposed in said housing means and coupled to said operating mechanism;

said latchable tripping means structured to actuate and maintain said operating mechanism means and said separable contact means in an open position;

a triggering means having a forward position and a backward position disposed in said housing means and accessible from said auxiliary device compartment;

said triggering means coupled to said latchable tripping means;

said triggering means structured to actuate said latchable tripping means when said triggering means is in said forward position whereby said latchable tripping means actuates and maintains said operating mechanism means so that said separable contact means are open; and a locking means disposed in said auxiliary device compartment in said housing means;

said locking means having a locked and unlocked position;

said locking means structured to engage said triggering means while said locking means is in said a predetermined state and maintain said triggering means in said forward position.

6. The combination as claimed in claim 5, wherein said state is the locked state.

7. A circuit interrupter, comprising:

a housing having an auxiliary device compartment therein;

an operating mechanism disposed in said housing;

separable contacts disposed in said housing having two contacts which are structured to open;

said operating mechanism coupled to and structured to open said separable contacts a triggerable tripping element disposed in said housing and coupled to said operating mechanism;

said triggerable tripping element structured to actuate said operating mechanism for opening said separable contacts;

a trigger having a forward position and a backward position disposed in said housing and accessible from said auxiliary device compartment;

said trigger coupled to said triggerable tripping element;

said trigger structured to trigger said triggerable tripping element to actuate said operating mechanism for opening said separable contacts when said trigger is in said forward position; and a lock disposed in said auxiliary device compartment in said housing;

said lock having a locked and unlocked position;

said lock structured to engage said trigger while said lock is in said locked position and maintain said trigger in said forward position.

8. A circuit interrupter, comprising:

a housing having an auxiliary device compartment therein;

an operating mechanism disposed in said housing;

separable contacts disposed in said housing having two contacts which are structured to open;

said operating mechanism coupled to and structured to open said separable contacts a latchable tripping element disposed in said housing and coupled to said operating mechanism;

said latchable tripping element structured to actuate and maintain said operating mechanism and said separable contacts in an open position;

a trigger having a forward position and a backward position disposed in said housing and accessible from said auxiliary device compartment;

said trigger coupled to said latchable tripping element;

said trigger structured to actuate said latchable tripping element when said trigger is in said forward position whereby said latchable tripping element actuates and maintains said operating mechanism so that said separable contact means are open; and a lock disposed in said auxiliary device compartment in said housing means;

said lock having a locked and unlocked position;

said lock structured to engage said trigger while said lock is in said a predetermined state and maintain said trigger in said forward position.

* * * * *